US010423090B2

(12) United States Patent
Ohtsu et al.

(10) Patent No.: US 10,423,090 B2
(45) Date of Patent: Sep. 24, 2019

(54) MAGENTA TONER AND TONER KIT

(71) Applicant: CANON KABUSHIKI KAISHA, Tokyo (JP)

(72) Inventors: Takeshi Ohtsu, Toride (JP); Yosuke Iwasaki, Abiko (JP); Wakiko Katsumata, Kashiwa (JP); Koh Ishigami, Abiko (JP); Masaharu Miura, Toride (JP); Kentaro Kamae, Kashiwa (JP); Kenta Mitsuiki, Toride (JP); Ryuichiro Matsuo, Moriya (JP); Yuichi Mizo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/203,864

(22) Filed: Nov. 29, 2018

(65) Prior Publication Data

US 2019/0171123 A1 Jun. 6, 2019

(30) Foreign Application Priority Data

Dec. 5, 2017 (JP) ..... 2017-233024

(51) Int. Cl.

| | |
|---|---|
| ***G03G 9/09*** | (2006.01) |
| ***G03G 9/087*** | (2006.01) |
| ***G03G 9/08*** | (2006.01) |

(52) U.S. Cl.

CPC ..... *G03G 9/091* (2013.01); *G03G 9/0819* (2013.01); *G03G 9/08755* (2013.01); *G03G 9/08782* (2013.01); *G03G 9/08786* (2013.01)

(58) Field of Classification Search

CPC ..... G03G 9/08755; G03G 9/08786; G03G 9/091; G03G 9/09733

See application file for complete search history.

(56) References Cited

U.S. PATENT DOCUMENTS

| | | | |
|---|---|---|---|
| 7,279,262 | B2 | 10/2007 | Fujikawa et al. |
| 7,288,348 | B2 | 10/2007 | Hayami et al. |
| 7,396,626 | B2 | 7/2008 | Fujikawa et al. |

(Continued)

FOREIGN PATENT DOCUMENTS

| | | | | |
|---|---|---|---|---|
| EP | 3136177 | * | 3/2017 | ..... G03G 9/0821 |
| JP | 2004-279476 | | 10/2004 | |

(Continued)

OTHER PUBLICATIONS

Translation of JP 2012-123227.*

(Continued)

*Primary Examiner* — Peter L Vajda
(74) *Attorney, Agent, or Firm* — Venable LLP

(57) ABSTRACT

Provided is a magenta toner having a magenta toner particle containing a binder resin, a colorant, a wax, a wax dispersant, and a crystalline polyester, wherein the wax dispersant is a graft polymer in which a styrene acrylic resin is grafted to a hydrocarbon compound, and the styrene acrylic resin has a monomer unit having a saturated alicyclic group, the colorant contains C.I. Pigment Red 32, and when observing a cross-section of the magenta toner particle using a transmission electron microscope (TEM), crystals of the crystalline polyester are dispersed in the cross-section, and the number average value of maximum lengths of the crystals is 50 nm or less.

10 Claims, 3 Drawing Sheets

(56) References Cited

U.S. PATENT DOCUMENTS

| | | | |
|---|---|---|---|
| 7,396,629 | B2 | 7/2008 | Baba et al. |
| 7,611,813 | B2 | 11/2009 | Ida et al. |
| 7,629,100 | B2 | 12/2009 | Okamoto et al. |
| 7,767,370 | B2 | 8/2010 | Ishigami et al. |
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,084,174 | B2 | 12/2011 | Hasegawa et al. |
| 8,137,886 | B2 | 3/2012 | Baba et al. |
| 8,288,069 | B2 | 10/2012 | Fujikawa et al. |
| 8,298,742 | B2 | 10/2012 | Okamoto et al. |
| 8,323,726 | B2 | 12/2012 | Naka et al. |
| 8,921,023 | B2 | 12/2014 | Baba et al. |
| 8,927,188 | B2 | 1/2015 | Naka et al. |
| 8,945,805 | B2 | 2/2015 | Baba et al. |
| 8,974,994 | B2 | 3/2015 | Kamae et al. |
| 8,986,914 | B2 | 3/2015 | Fujikawa et al. |
| 9,034,551 | B2 | 5/2015 | Endo et al. |
| 9,046,800 | B2 | 6/2015 | Hotta et al. |
| 9,058,924 | B2 | 6/2015 | Komatsu et al. |
| 9,063,443 | B2 | 6/2015 | Ishigami et al. |
| 9,075,328 | B2 | 7/2015 | Minagawa et al. |
| 9,152,088 | B1 | 10/2015 | Kobori et al. |
| 9,372,420 | B2 | 6/2016 | Mizo et al. |
| 9,417,540 | B2 | 8/2016 | Hashimoto et al. |
| 9,665,021 | B2 | 5/2017 | Ohtsu et al. |
| 9,665,023 | B2 | 5/2017 | Kamae et al. |
| 9,665,026 | B2 | 5/2017 | Iwasaki et al. |
| 9,671,707 | B2 | 6/2017 | Minagawa et al. |
| 9,915,885 | B2 | 3/2018 | Katsumata et al. |
| 9,969,834 | B2 | 5/2018 | Ohtsu et al. |
| 10,012,918 | B2 | 7/2018 | Ishigami et al. |
| 10,012,921 | B2 | 7/2018 | Kamae et al. |
| 10,082,743 | B2 * | 9/2018 | Hama ..... G03G 9/08755 |
| 10,133,201 | B2 | 11/2018 | Kamae et al. |
| 2010/0028796 | A1 | 2/2010 | Nakamura et al. |
| 2010/0183971 | A1 | 7/2010 | Fujikawa et al. |
| 2012/0214097 | A1 | 8/2012 | Naka et al. |
| 2013/0244159 | A1 | 9/2013 | Ishigami et al. |
| 2013/0288173 | A1 | 10/2013 | Hashimoto et al. |
| 2013/0309603 | A1 | 11/2013 | Takahashi et al. |
| 2014/0134535 | A1 | 5/2014 | Baba et al. |
| 2014/0137428 | A1 | 5/2014 | Takenaka et al. |
| 2014/0329176 | A1 | 11/2014 | Kanno et al. |
| 2017/0269493 | A1 | 9/2017 | Ohtsu et al. |
| 2018/0052402 | A1 | 2/2018 | Iwasaki et al. |
| 2018/0275540 | A1 | 9/2018 | Matsuo et al. |

FOREIGN PATENT DOCUMENTS

| | | | |
|---|---|---|---|
| JP | 2005-107147 | 4/2005 | |
| JP | 2012-123227 * | 6/2012 | ..... G03G 9/09 |

OTHER PUBLICATIONS

U.S. Appl. No. 16/056,630, Kentaro Kamae, filed Aug. 7, 2018.
U.S. Appl. No. 16/136,676, Kentaro Kamae, filed Sep. 20, 2018.
U.S. Appl. No. 16/148,446, Junichi Tamura, filed Oct. 1, 2018.

* cited by examiner

MAGENTA TONER AND TONER KIT

BACKGROUND OF THE INVENTION

Field of the Invention

The present invention relates to a magenta toner and a toner kit used in an electrophotographic method, an electrostatic recording method, and an electrostatic printing method.

Description of the Related Art

In recent years, with the development of color image forming technology by an electrophotographic method, the demand for high image quality of an additional layer is gradually increasing. In order to achieve high image quality, it is important to improve dispersibility of a pigment in toner particles and to maximize a coloring ability of the pigment in the toner particles. In the case of a full-color image, color reproduction is performed with a four-color toner obtained by including chromatic color toners of three primary colors of color material, i.e., yellow toner, magenta toner, and cyan toner, and further adding a black toner thereto.

The magenta toner is important in reproducing a red color to which humans have a high visual sensitivity by mixing the magenta toner with the yellow toner, and excellent developability is required when reproducing the skin color of a person having a complicated color tone.

From the viewpoint of color reproducibility and coloring power, it is known that a conventional magenta toner uses a quinacridone-based colorant or a naphthol-based colorant alone or in a mixture thereof. As a magenta toner using a colorant alone, for example, a toner using a monoazo naphthol pigment has been proposed (see Japanese Patent Application Laid-Open No. 2005-107147).

Further, in order to improve low-temperature fixability of the toner, a toner containing a crystalline polyester in a binder resin has been developed. By containing the crystalline polyester in the toner, it is possible to maintain hardness up to a fixing temperature while quickly melting at the fixing temperature, and thus storage stability and durability can be improved.

In Japanese Patent Application Laid-Open No. 2004-279476, it is attempted to achieve both compatibility between low-temperature fixability and hot offset resistance by setting a long axis diameter of crystals of the crystalline polyester in the toner to 0.5 μm or more while simultaneously being ½ or less of the toner diameter.

As can be seen from these disclosed techniques, since characteristics of the toner significantly change depending on the state of existence of the colorant and the crystalline polyester in the toner, controlling the state of existence thereof is an important technology for maximizing performance of the colorant and the crystalline polyester.

In particular, when the crystalline polyester is contained in the magenta toner, a number of naphthol-based pigments have low dispersibility and dispersion of the crystalline polyester or other materials is inhibited, and thus as compared to other colors, it is required to improve low-temperature fixability and hot offset resistance and further coloring power.

SUMMARY OF THE INVENTION

The present invention is directed to providing a magenta toner and a toner kit in which the above problems have been solved. Specifically, the present invention is directed to providing a magenta toner and a toner kit having excellent low-temperature fixability and hot offset resistance and excellent coloring power.

As a result of intensive research, the present inventors found that the following constitution is important for providing a magenta toner and a toner kit having excellent low-temperature fixability and hot offset resistance and excellent coloring power, and completed the present invention.

That is, the magenta toner according to an embodiment of the present invention is a magenta toner including magenta a toner particle containing a binder resin, a colorant, a wax, a wax dispersant, and a crystalline polyester, wherein the wax dispersant is a graft polymer in which a styrene acrylic resin is grafted to a hydrocarbon compound, and the styrene acrylic resin has a monomer unit having a saturated alicyclic group, the colorant contains Compound (1) represented by Formula below, (1)

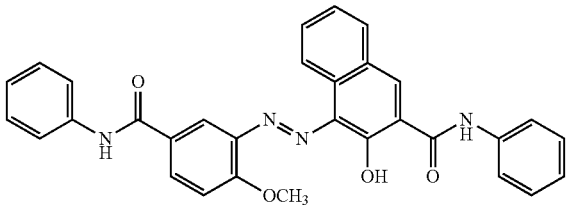

a content of the compound (1) in the magenta toner particle is 0.5 parts by mass or more and 20.0 parts by mass or less with respect to 100 parts by mass of the binder resin, the colorant further contains, in addition to the compound (1), at least one compound selected from the group consisting of a naphthol-based compound, a quinacridone-based compound, and a lake compound thereof, and when observing a cross-section of the magenta toner particle using a transmission electron microscope (TEM), crystals of the crystalline polyester are dispersed in the cross-section, and the number average value of the maximum lengths of the crystals is 50 nm or less.

Further, the toner kit according to another embodiment of the present invention is a toner kit including:

a cyan toner, a black toner, a yellow toner, and a magenta toner, wherein the magenta toner is a magenta toner having the above-described constitution, the black toner is a black toner having a black toner particle containing a binder resin, a colorant, a wax, a wax dispersant, and a crystalline polyester, the yellow toner is a yellow toner having an yellow toner particle containing a binder resin, a colorant, a wax, a wax dispersant, and a crystalline polyester, the cyan toner is a cyan toner having a cyan toner particle containing a binder resin, a colorant, a wax, a wax dispersant, and a crystalline polyester, each of the wax dispersants in the black toner particle, the yellow toner particle, and the cyan toner particle is a graft polymer in which a styrene acrylic resin is grafted to a hydrocarbon compound, and the styrene acrylic resin has a monomer unit having a saturated alicyclic group, and when observing a cross-section of each of the black toner particle, the yellow toner particle, and the cyan toner particle using a transmission electron microscope (TEM), crystals of the crystalline polyester observed in a needle shape are dispersed in each cross-section, and the number average value of long axis lengths of the crystals to be observed is 60 nm or more and 250 nm or less, respectively.

Further features of the present invention will become apparent from the following description of exemplary embodiments with reference to the attached drawings.

DESCRIPTION OF THE EMBODIMENTS

Figure 1:
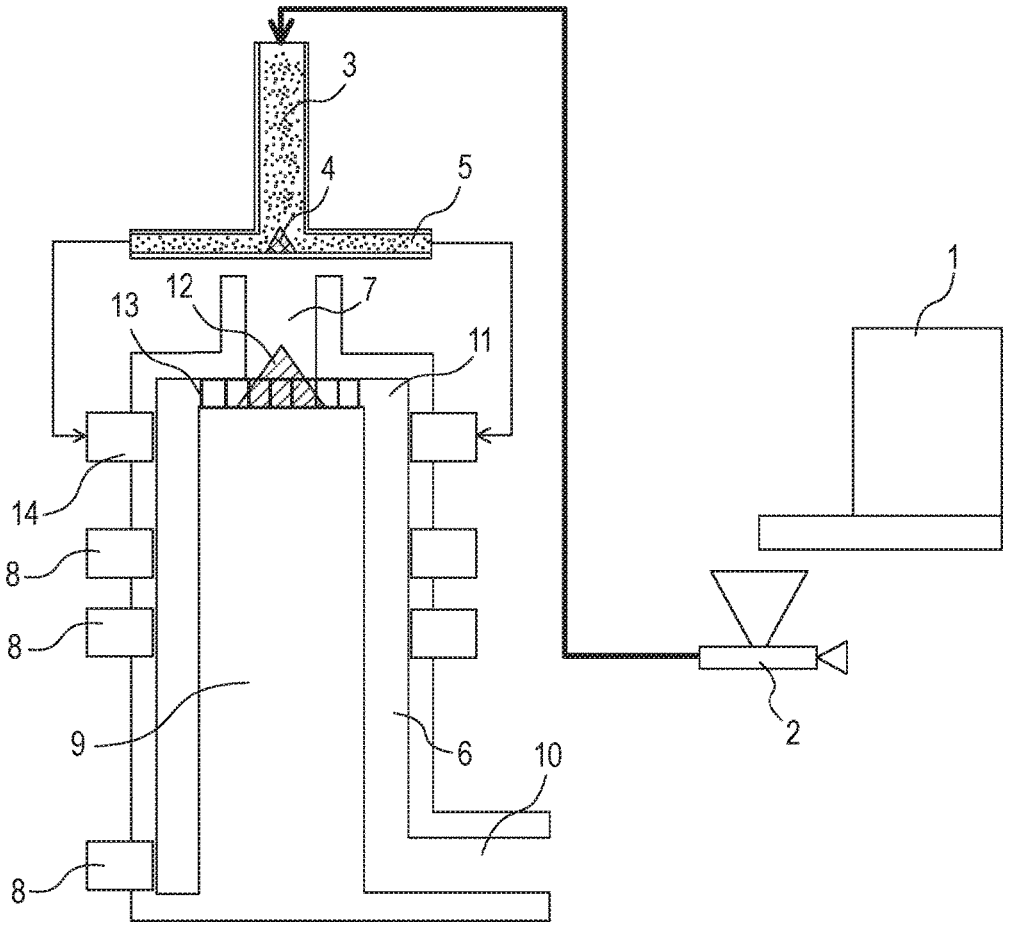
FIG. 1 is a schematic diagram of a thermal sphering treatment apparatus used in the present invention.

A magenta toner according to an embodiment of the present invention is a magenta toner including magenta a toner particle containing a binder resin, a colorant, a wax, a wax dispersant, and a crystalline polyester, wherein the wax dispersant is a graft polymer in which a styrene acrylic resin is grafted to a hydrocarbon compound, and the styrene acrylic resin has a monomer unit having a saturated alicyclic group, the colorant contains Compound (1) represented by Formula below, (1)

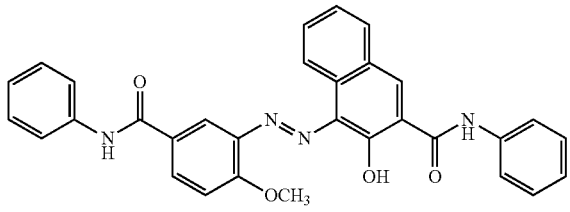

a content of the compound (1) in the magenta toner particle is 0.5 parts by mass or more and 20.0 parts by mass or less with respect to 100 parts by mass of the binder resin, the colorant further contains, in addition to the compound (1), at least one compound selected from the group consisting of a naphthol-based compound, a quinacridone-based compound, and a lake compound thereof, and when observing a cross-section of the magenta toner particle using a transmission electron microscope (TEM), crystals of the crystalline polyester are dispersed in the cross-section, and the number average value of the maximum lengths of the crystals is 50 nm or less.

It should be noted that the compound (1) is C.I. Pigment Red 32.

A magenta toner according to an embodiment of the present invention is a toner in which crystalline polyester is finely dispersed. The reason why the crystalline polyester is finely dispersed is considered as follows.

The wax dispersant used in the present invention interacts with the wax, and the wax is dispersed in the binder resin. Further, since the compound (1) has a crystal structure like wax, the compound (1) also interacts with the dispersed wax to be dispersed in the binder resin. At the same time, since the compound (1) also interacts with a pigment such as a naphthol-based compound, a quinacridone-based compound, or a lake compound thereof, the pigment is finely dispersed in the binder resin. Further, since the crystalline polyester also has a crystal structure, the crystalline polyester interacts with the finely dispersed wax and the pigment, and thus the crystalline polyester is also finely dispersed in the binder resin.

In the magenta toner, when observing a cross-section of the toner particle using a transmission electron microscope (TEM), it is necessary to confirm that crystals of the crystalline polyester are dispersed in the cross-section. In a dispersion state at this time, regardless of the shape such as a needle shape or a circular shape, the number average value of the maximum lengths of the crystals (a distance between two straight lines when the distance between the two straight lines becomes maximum in the case where the crystal domain is interposed so as to be in contact with two parallel straight lines) may be 50 nm or less. Since the crystalline polyester is finely dispersed to 50 nm or less, the low-temperature fixability and hot offset resistance are both achieved. The reason for this is considered because the crystalline polyester which exists as a crystal assists in releasing the wax. In addition, the effect of the invention can be obtained if the crystalline polyester has a size that can be confirmed to exist as a crystal, but it is more preferable that the maximum length of the crystal is 10 nm or more.

Further, in the magenta toner according to an embodiment of the present invention, it is considered that the hot offset resistance is improved because the pigment containing the compound (1) and the wax in the toner are well dispersed. The reason for this is described below.

An organic pigment surface generally has a low polarity. This is because there are some polar groups in the molecular structure of the pigments, but when the pigment crystallizes, molecules are often overlapped with each other mainly on the interaction between polar groups, and thus the number of polar groups exposed to the particle surface is reduced. Therefore, since the pigment surface having low polarity and low energy has a small force for adsorbing the polar group in the dispersion medium, it is difficult to maintain a stable dispersion state.

The compound (1) is a naphthol-based pigment, has amino groups at both ends and acts as a synergist, thus exhibiting an effect of improving dispersibility with respect to other pigments. Since the compound (1) has the same amino groups at both ends, affinity with polyester is higher than that of the conventionally used naphthol-based pigment. Therefore, it is considered that the pigment is difficult to be re-aggregated, dispersibility of the pigment itself is improved, and dispersion inhibition of the wax can be suppressed. In addition, the pigment derivative such as the compound (1) is very effective for a quinacridone-based pigment having no functional group, has high affinity with other naphthol-based pigments, and further improves dispersibility of the wax by combining with these magenta colorants, thereby obtaining hot offset resistance and color reproducibility.

Examples of the naphthol-based compound, the quinacridone-based compound, and the lake compound thereof in combination with the compound (1) may include the following compounds.

Examples of the naphthol-based compound may include C.I. Pigment Red 31, 147, 150, 184, 238, 269, and the like.

Examples of the quinacridone-based compound may include C.I. Pigment Red 122, 192, and 282, C.I. Pigment Violet 19, and the like.

Examples of the lake compounds of the naphthol-based compound and the quinacridone-based compound may include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, and 282; C.I. Pigment Violet 19; C. I. Vat Red 1, 2, 10, 13, 15, 23, 29, and 35, and the like.

Examples of the magenta colorant may include the following compounds; Oil soluble dye such as C. I. Solvent Red 1, 3, 8, 23, 24, 25, 27, 30, 49, 81, 82, 83, 84, 100, 109, 121; C. I. Disperse Red 9; C. I. Solvent Violet 8, 13, 14, 21, 27; C. I. Disperse Violet 1, Basic dye such as C. I. Basic Red 1, 2, 9, 12, 13, 14, 15, 17, 18, 22, 23, 24, 27, 29, 32, 34, 35, 36, 37, 38, 39, and 40; and C. I. Basic Violet 1, 3, 7, 10, 14, 15, 21, 25, 26, 27, and 28.

As other compounds to be combined with the compound (1), compounds selected from naphthol-based compounds and quinacridone-based compounds are preferable, and compounds selected from naphthol-based pigments and quinacridone-based pigments are more preferable. When used in combination with the compound (1), dispersibility in the toner particles is increased, and color reproducibility of the toner and hot offset resistance during fixing are improved.

Examples of the naphthol-based compound other than the compound (1) may include a compound represented by Formula (I) below:

(I)

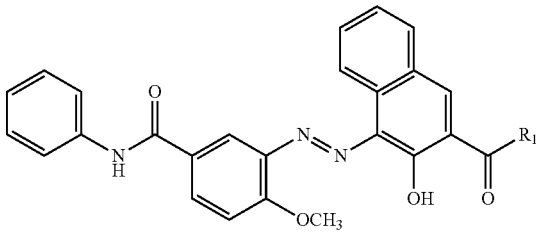

(I-2)

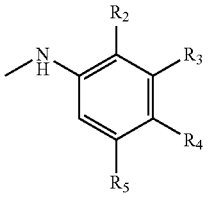

(in Formula, $R_1$ represents —$NH_2$ or a group of the above Formula (I-2). In Formula (I-2), $R_2$ to $R_5$ each independently represent a hydrogen atom, a chlorine atom, —$NO_2$, an alkyl group having 1 to 4 carbon atoms, or an alkoxy group having 1 to 4 carbon atoms).

When $R_1$ in the compound represented by Formula (I) is a group of Formula (I-2) and the group of Formula (I-2) has an alkyl group having 1 to 4 carbon atoms, the alkyl group is preferably a methyl group.

In addition, when $R_1$ in the compound represented by Formula (I) is a group of Formula (I-2) and the group of Formula (I-2) has an alkoxy group having 1 to 4 carbon atoms, the alkoxy group is preferably a methoxy group.

Examples of the quinacridone-based compound may include a compound represented by Formula (II) below:

(II)

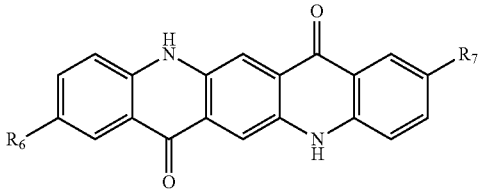

(in Formula, $R_6$ and $R_7$ each independently represent a hydrogen atom or an alkyl group having 1 to 4 carbon atoms).

When $R_6$ and/or $R_7$ in the compound represented by Formula (II) is an alkyl group having 1 to 4 carbon atoms, the alkyl group is preferably a methyl group.

Further, examples of the lake compound may include metal salts of calcium, barium, strontium, manganese, and the like.

In addition, the compound (1) may be treated with a surface treatment agent or a rosin compound by conventionally known methods. In particular, since the treatment with the rosin compound prevents re-aggregation of the pigment, dispersibility of the pigment in the toner particles can be improved, and further chargeability of the toner can be made to a desirable state.

Examples of the rosin compound may include natural rosin such as tall oil rosin, gum rosin, wood rosin; modified rosin such as hydrogenated rosin, disproportionated rosin, polymerized rosin; synthetic rosin such as styrene acryl rosin; and alkali metal salt or ester compounds of the rosin.

Particularly, it is preferable to use abietic acid, tetrahydroabietic acid, neoabietic acid, dehydroabietic acid, dihydroabietic acid, pimaric acid, isopimaric acid, levopimaric acid, palustric acid, and alkali metal salts thereof or ester compounds thereof from the viewpoint of compatibility with the binder resin, which improves dispersibility of the pigment and develops coloring property of the toner.

An example of the method of treating the compound (1) with the rosin compound may include (a) a dry mixing method in which the rosin compound and the compound (1) are dry mixed, and then heat treatment such as melting and kneading, or the like, is performed, if necessary. In addition, another example of the method thereof may include (b) a wet treatment method in which at the time of preparing the compound (1), an aqueous alkaline solution of rosin is added to the synthetic solution of the compound (1), and then a lake metal salt such as calcium, barium, strontium or manganese is added, and the rosin is insolubilized, thereby performing a coating treatment on a surface.

A treatment amount of the rosin compound to the compound (1) is such that the amount of the rosin compound is 1% by mass or more and 40% by mass or less, preferably 5% by mass or more and 30% by mass or less, and more preferably 10% by mass or more and 20% by mass or less. By setting the treatment amount as above, the above characteristics can be further improved.

The content of the compound (1) in the magenta toner particles is 0.5 parts by mass or more and 20.0 parts by mass or less with respect to 100 parts by mass of the binder resin. The content of the compound (1) in the magenta toner particles is more preferably 1.0 part by mass or more and 3.0 parts by mass or less.

In addition, the content of the colorant in the magenta toner particles (the total content of the compound combined with the compound (1)) is preferably 5.0 parts by mass or more and 25.0 parts by mass or less with respect to 100 parts by mass of the binder resin.

A toner kit according to another embodiment of the present invention is a toner kit including a cyan toner, a black toner, a yellow toner, and a magenta toner, the black toner is a black toner having black a toner particle containing a binder resin, a colorant, a wax, a wax dispersant, and a crystalline polyester, the yellow toner is a yellow toner having an yellow toner particle containing a binder resin, a colorant, a wax, a wax dispersant, and a crystalline polyester, the cyan toner is a cyan toner having a cyan toner particle containing a binder resin, a colorant, a wax, a wax dispersant, and a crystalline polyester, each of the wax dispersants in the black toner particle, the yellow toner particle, and the cyan toner particle is a polymer in which a styrene acrylic polymer is graft-modified to polyolefin, and the styrene acrylic polymer has a monomer unit having a saturated alicyclic group, and when observing a cross-section of each of the black toner particle, the yellow toner particle, and the cyan toner particle using a transmission electron microscope (TEM), crystals of the crystalline polyester observed in a needle shape are dispersed in each cross-section, and the number average value of long axis lengths of the crystals to be observed is 60 nm or more and 250 nm or less, respectively.

In the present invention, by setting a long axis length of the black toner, the yellow toner, and the cyan toner within the above-described range, both the low-temperature fixability and hot offset resistance can be achieved.

In the toner kit according to another embodiment of the present invention, the cross-section of the crystal of the magenta toner is different from the cross-section of the crystal of the black toner, the yellow toner, and the cyan toner, which is preferable as the toner kit since the low-temperature fixability, hot offset resistance, and coloring power are uniform. In addition, it is necessary to finely disperse the crystalline polyester only in the magenta toner as compared to other colors, which is because it is preferable to increase the content of the colorant in order to exhibit the same coloring power as the other colors.

In the toner kit, it is preferable that a solubility parameter SP1 of the crystalline polyester and a solubility parameter SP2 of the wax dispersant in the toner satisfy the relationship of Formula below:

$$0 \leq SP1 - SP2 \leq 1.3$$

When both solubility parameters satisfy the above relationship, the affinity between the wax dispersant and the crystalline polyester is improved, thereby improving dispersibility of the wax and the crystalline polyester. The improvement in the dispersibility of the wax allows improvement in hot offset resistance, and the improvement in the dispersibility of the crystalline polyester allows improvement in the low-temperature fixability.

In addition, the solubility parameter is calculated using the Fedors method. The evaporation energy (Δei[cal/mole]) and the molar volume (Δvi[cal/mole]) used in this calculation are values described in "Fundamental Theory of Adhesion", Chapter 5, R. F. Fedors, Polym. Eng. Sci. 14, 147 (1974) written by Minoru Inoue. Further, in the present invention, calculation is performed based on the structure of the polymer constituent unit.

The wax dispersant used in the present invention is a wax dispersant for a toner containing a graft polymer in which a styrene acrylic resin is grafted to a hydrocarbon compound, and the styrene acrylic resin has a monomer unit having a saturated alicyclic group.

In the wax dispersant, the styrene acrylic resin moiety has affinity with the resin constituting the toner particles, and the hydrocarbon compound moiety has affinity with the wax contained in the toner particles. Therefore, the wax can be finely dispersed in the toner particles.

The hydrocarbon compound used in the synthesis of the graft polymer is not particularly limited, but can be selected from the wax described below, for example, from the viewpoint of affinity with the wax in the toner particle.

The hydrocarbon compound preferably has a peak temperature of the highest endothermic peak measured using a differential scanning calorimeter (DSC) of 60° C. or more and 110° C. or less. In addition, a weight average molecular weight (Mw) of the hydrocarbon compound is preferably 900 or more and 50,000 or less.

Preferable examples of the hydrocarbon compound may include hydrocarbon-based waxes such as low molecular weight polyethylene, low molecular weight polypropylene, alkylene copolymers, microcrystalline wax, paraffin wax, and Fischer-Tropsch wax.

In addition, from the viewpoint of reactivity at the time of preparing the wax dispersant, it is preferable to have a branched structure such as polypropylene.

A proportion of the hydrocarbon compound moiety is preferably 5.0% by mass or more and 20.0% by mass or less, and more preferably 8.0% by mass or more and 12.0% by mass or less, in the graft polymer in which the styrene acrylic resin is grafted to the hydrocarbon compound.

In addition, in the present invention, a method of grafting a styrene acrylic resin to a hydrocarbon compound is not particularly limited, and conventionally known methods can be used.

In the wax dispersant, the styrene acrylic resin is not particularly limited as long as it has a monomer unit having a saturated alicyclic group.

For example, the styrene-acrylic resin may have a monomer unit represented by Formula (1) below.

Here, the monomer unit refers to a reaction form of the monomer material in the polymer.

Formula (1)

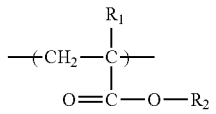

(in Formula (1), $R_1$ represents a hydrogen atom or a methyl group, and $R_2$ represents a saturated alicyclic group).

The saturated alicyclic group in $R_2$ is preferably a saturated alicyclic hydrocarbon group, more preferably a saturated alicyclic hydrocarbon group having 3 to 18 carbon atoms, and further preferably a saturated alicyclic hydrocarbon group having 4 to 12 carbon atoms. Examples of the saturated alicyclic hydrocarbon group include a cycloalkyl group, a condensed polycyclic hydrocarbon group, a cross-linked ring hydrocarbon group, a spiro hydrocarbon group, and the like.

Examples of the saturated alicyclic groups may include a cyclopropyl group, a cyclobutyl group, a cyclopentyl group, a cyclohexyl group, a t-butylcyclohexyl group, a cycloheptyl group, a cyclooctyl group, a tricyclodecanyl group, a decahydro-2-naphthyl group, a tricyclo [5.2.1.02,6] decan-8-yl group, a pentacyclopentadecanyl group, an isobonyl group, an adamantyl group, a dicyclopentanyl group, a tricyclopentanyl group, and the like.

As the monomer unit, a monomer unit having the following structure in which the saturated alicyclic group is a cyclohexyl group is particularly preferable:

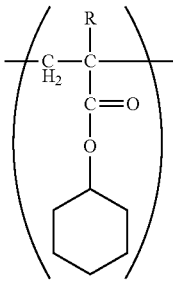

(in Formula, R represents a hydrogen atom or a methyl group).

Further, the saturated alicyclic group may have an alkyl group, a halogen atom, a carboxy group, a carbonyl group, a hydroxy group, or the like, as a substituent. As the alkyl group, an alkyl group having 1 to 4 carbon atoms is preferable.

Among these saturated alicyclic groups, a cycloalkyl group, a condensed polycyclic hydrocarbon group, and a cross-linked ring hydrocarbon group are preferable; a cycloalkyl group having 3 to 18 carbon atoms, a substituted or unsubstituted dicyclopentanyl group, a substituted or unsubstituted tricyclopentanyl group are more preferable; a cycloalkyl group having 4 to 12 carbon atoms is further preferable; and a cycloalkyl group having 6 to 10 carbon atoms is particularly preferable.

In addition, the position and the number of the substituent are arbitrary, and when two or more substituents are present, the substituents may be the same as or different from each other.

In the present invention, the content ratio of the monomer unit represented by Formula (1) is preferably 1.5 mol % or more and 45.0 mol % or less, and more preferably 3.0 mol % or more and 25.0 mol % or less, based on the total monomer units constituting the styrene acrylic resin.

The styrene acrylic resin may be a homopolymer of the vinyl-based monomer (a) having a saturated alicyclic group, or may be a copolymer of the vinyl-based monomer (a) and the other monomer (b).

Examples of the vinyl-based monomer (a) may include monomers such as cyclopropyl acrylate, cyclobutyl acrylate, cyclopentyl acrylate, cyclohexyl acrylate, cycloheptyl acrylate, cyclooctyl acrylate, cyclopropyl methacrylate, cyclobutyl methacrylate, cyclopentyl methacrylate, cyclohexyl methacrylate, cycloheptyl methacrylate, cyclooctyl methacrylate, dihydrocyclopentadiethyl acrylate, dicyclopentanyl acrylate, dicyclopentanyl methacrylate, and the like, and a combination thereof.

Among them, cyclohexyl acrylate, cycloheptyl acrylate, cyclooctyl acrylate, cyclohexyl methacrylate, cycloheptyl methacrylate, and cyclooctyl methacrylate are preferable from the viewpoint of hydrophobicity.

Examples of the other monomer (b) may include styrene-based monomers such as styrene, α-methylstyrene, p-methylstyrene, m-methylstyrene, p-methoxystyrene, p-hydroxy styrene, p-acetoxystyrene, vinyltoluene, ethylstyrene, phenylstyrene, benzylstyrene, and the like; alkyl esters of unsaturated carboxylic acids such as methyl acrylate, ethyl acrylate, butyl acrylate, 2-ethylhexyl acrylate, methyl methacrylate, ethyl methacrylate, butyl methacrylate, 2-ethylhexyl methacrylate, and the like (the alkyls having 1 or more and 18 or less carbon atoms); vinyl ester-based monomers such as vinyl acetate; vinyl ether-based monomers such as vinyl methyl ether; halogen element-containing vinyl-based monomers such as vinyl chloride; dien-based monomers such as butadiene, isobutylene, and the like; and a combination thereof.

In addition, in order to adjust the polarity, a monomer to which an acid group or a hydroxyl group is added may be used. Examples of the monomer to which an acid group or a hydroxyl group is added may include acrylic acid, methacrylic acid, maleic anhydride, maleic acid half ester, 2-ethylhexyl acrylate, and the like.

In the present invention, it is preferable that the styrene-acrylic resin has a monomer unit represented by Formula (2) below from the viewpoint of low-temperature fixability of the toner.

When the styrene-acrylic resin has a monomer unit represented by Formula (2), a glass transition temperature (Tg) of the wax dispersant tends to be lowered. As a result, when the wax dispersant is contained in the toner particles, even if the toner is left under high temperature and high humidity, chargeability is not lowered and simultaneously the low-temperature fixability is further improved.

In the present invention, the content ratio of the monomer unit represented by Formula (2) below is preferably 5.0 mol % or more and 30.0 mol % or less, and more preferably 10.0 mol % or more and 20.0 mol % or less based on the total monomer units constituting the styrene acrylic resin:

Formula (2)

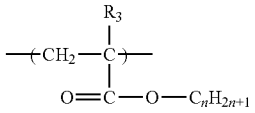

(in Formula (2), $R_3$ represents a hydrogen atom or a methyl group, and n represents an integer of 1 or more and 18 or less).

In the monomer unit represented by Formula (2), n in Formula (2) is preferably an integer of 3 or more and 12 or less.

The acid value of the wax dispersant is preferably 5 mgKOH/g or more and 50 mgKOH/g or less, and more preferably 15 mgKOH/g or more and 35 mgKOH/g or less.

When the acid value of the wax dispersant is within the above-described range, the affinity between the wax dispersant and the resin in the toner is further improved, thus resulting in further improvement of the wax dispersibility in the toner. Further, the hydrophobicity of the toner particles becomes appropriate, and thus the chargeability under high temperature and high humidity is further improved.

The toner preferably has toner particles containing a binder resin, a wax and a wax dispersant for the toner, and the binder resin preferably contains an amorphous polyester.

When polyester is used as the binder resin, compatibility of the polyester and the wax is low. Therefore, when the wax is added as it is and contained in the toner particles, the wax segregates and exists in the toner particles, and free wax and the like, occur. As a result, there are some unpreferable cases since problems such as poor charging and the like occur.

Meanwhile, when the toner contains the above-described wax dispersant and further contains the crystalline polyester together with the binder resin, a dispersion state of the wax and the crystalline polyester in the toner particles is controlled. As a result, sufficient chargeability can be exhibited even under strict conditions for exhibiting the chargeability while satisfying the low-temperature fixability, hot offset resistance, and blocking resistance.

The content of the crystalline polyester in the toner particles is preferably 1.0 part by mass or more and 15.0 parts by mass or less, and more preferably 2.0 parts by mass or more and 10.0 parts by mass or less, based on 100 parts by mass of the amorphous polyester.

When the content of the crystalline polyester is within the above-described range, the low-temperature fixability is improved. That is, when the content of the crystalline polyester is 15.0 parts by mass or less, it is easy to finely disperse the crystalline polyester in the toner particles and the low-temperature fixability is improved.

Further, the content of the wax dispersant for the toner in the toner particles is preferably 2.0 parts by mass or more and 15.0 parts by mass or less, and more preferably 4.0 parts by mass or more and 7.5 parts by mass or less, based on 100.0 parts by mass of the amorphous polyester.

In the present invention, a crystalline polyester is contained together with a binder resin. In the present invention, "crystallinity" means that an endothermic peak is observed in differential scanning calorimeter (DSC).

The crystalline polyester can be obtained by reacting a polyvalent carboxylic acid having 2 or more valences with a diol. Among them, a resin obtained by condensation polymerization of an aliphatic diol and an aliphatic dicarboxylic acid is preferable due to high crystallinity. Further, in the present invention, only one type of the crystalline polyester may be used, or a plurality of types of the crystalline polyester may be used in combination.

In the present invention, the crystalline polyester is preferably a resin obtained by condensation polymerization of an alcohol component containing at least one compound selected from the group consisting of aliphatic diols having 2 to 22 carbon atoms and derivatives thereof and a carboxylic acid component containing at least one compound selected from the group consisting of aliphatic dicarboxylic acids having 2 to 22 carbon atoms and derivatives thereof.

Among them, the crystalline polyester is more preferably a crystalline polyester obtained by condensation polymerization of an alcohol component containing at least one compound selected from the group consisting of aliphatic diols having 6 to 12 carbon atoms and derivatives thereof and a carboxylic acid component containing at least one compound selected from the group consisting of aliphatic dicarboxylic acids having 6 to 12 carbon atoms and derivatives thereof, from the viewpoints of low-temperature fixability and blocking resistance.

The aliphatic diol having 2 to 22 carbon atoms (preferably 6 to 12 carbon atoms) is not particularly limited, but may be a chain (preferably straight chain) aliphatic diol.

Examples of the chain (preferably straight chain) aliphatic diol having 2 to 22 carbon atoms may include ethylene glycol, diethylene glycol, triethylene glycol, 1,2-propylene glycol, dipropylene glycol, 1,3-propanediol, 1,4-butanediol, 1,4-butadiene glycol, 1,5-pentanediol, neopentyl glycol, 1,6-hexanediol, 1,7-heptanediol, 1,8-octanediol, 1,9-nonanediol, 1,10-decanediol, 1,11-undecanediol, and 1,12-dodecanediol.

Among them, preferable examples of the chain (preferably straight chain) aliphatic diol having 2 to 22 carbon atoms may include linear aliphatic α, ω-diol such as 1,6-hexanediol, 1,7-heptanediol, 1,8-octanediol, 1,9-nonanediol, 1,10-decanediol, 1,11-undecanediol, 1,12-dodecanediol.

In the present invention, the derivative is not particularly limited as long as it is possible to obtain the same resin structure by the above-described condensation polymerization. For example, the derivative may be a derivative obtained by esterifying the above-described diol.

In the present invention, in the alcohol component constituting the crystalline polyester, at least one compound selected from the group consisting of aliphatic diols having 2 to 22 carbon atoms (preferably 6 to 12 carbon atoms) and derivatives thereof is preferably included in a content of 50% by mass or more, and more preferably 70% by mass or more, with respect to the total alcohol component.

In the present invention, a polyvalent alcohol other than the aliphatic diol may be used.

Among the polyvalent alcohols, examples of the diol other than the aliphatic diol may include aromatic alcohols such as polyoxyethylenated bisphenol A, polyoxypropylenated bisphenol A, and the like; and 1,4-cyclohexane dimethanol, and the like.

Further, examples of a trivalent or higher polyvalent alcohol among the polyvalent alcohols may include aromatic alcohols such as 1,3,5-trihydroxymethylbenzene, and the like; and aliphatic alcohols such as pentaerythritol, dipentaerythritol, tripentaerythritol, 1,2,4-butanetriol, 1,2,5-pentanetriol, glycerin, 2-methylpropane triol, 2-methyl-1,2,4-butanetriol, trimethylolethane, trimethylolpropane, and the like.

Further, in the present invention, a monovalent alcohol may be used to the extent that characteristics of the crystalline polyester are not impaired. Examples of the monovalent alcohol may include n-butanol, isobutanol, sec-butanol, n-hexanol, n-octanol, 2-ethylhexanol, cyclohexanol, benzyl alcohol, and the like.

Meanwhile, the aliphatic dicarboxylic acid having 2 to 22 carbon atoms (preferably 6 to 12 carbon atoms) is not particularly limited, but may be a chain (preferably straight chain) aliphatic dicarboxylic acid.

For example, examples of the chain aliphatic dicarboxylic acid may include oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid, and itaconic acid.

Hydrolysis products obtained by hydrolyzing these acid anhydrides or lower alkyl esters and the like, are also included.

In the present invention, the derivative is not particularly limited as long as it is possible to obtain the same resin structure by the above-described condensation polymerization. For example, the derivative may include derivatives obtained by methyl esterification, ethyl esterification, or acid chlorination of the acid anhydride of the dicarboxylic acid component or the dicarboxylic acid component.

In the present invention, in the carboxylic acid component constituting the crystalline polyester, at least one compound selected from the group consisting of an aliphatic dicarboxylic acid having 2 to 22 carbon atoms (preferably 6 to 12 carbon atoms) and derivatives thereof is preferably included in a content of 50% by mass or more, and more preferably 70% by mass or more, with respect to the total alcohol component.

In the present invention, a polyvalent carboxylic acid other than the aliphatic dicarboxylic acid may be used. Among the polyvalent carboxylic acids, examples of the divalent carboxylic acid other than the aliphatic dicarboxylic acid may include aromatic carboxylic acids such as isophthalic acid, terephthalic acid, and the like; aliphatic carboxylic acids such as n-dodecylsuccinic acid and n-dodecenylsuccinic acid, and the like; alicyclic carboxylic acids such as cyclohexanedicarboxylic acid, and the like; and acid anhydrides or lower alkyl esters thereof, and the like.

Further, in the other polyvalent carboxylic acids, examples of the trivalent or higher polyvalent carboxylic acid may include aromatic carboxylic acids such as 1,2,4-benzenetricarboxylic acid (trimellitic acid), 2,5,7-naphthalenetricarboxylic acid, 1,2,4-naphthalene tricarboxylic acid, pyromellitic acid, and the like; aliphatic carboxylic acids such as 1,2,4-butanetricarboxylic acid, 1,2,5-hexanetricarboxylic acid, and 1,3-dicarboxyl-2-methyl-2-methylene carboxypropane; and the like. Derivatives such as acid anhydrides or lower alkyl esters thereof, and the like, are also included.

Further, in the present invention, a monovalent carboxylic acid may be used to the extent that characteristics of the crystalline polyester are not impaired. Examples of the monovalent carboxylic acid may include benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, and the like.

In the present invention, the crystalline polyester can be produced by a conventional polyester synthesis method. For example, the carboxylic acid component and the alcohol component are subjected to an esterification reaction or a transesterification reaction, followed by condensation polymerization under a reduced pressure or by introduction of a nitrogen gas according to a conventional method, thereby obtaining a crystalline polyester.

The esterification or transesterification reaction may be performed, if necessary, using a conventional esterification catalyst or a transesterification catalyst such as sulfuric acid, titanium butoxide, tin 2-ethylhexanoate, dibutyltin oxide, manganese acetate, and magnesium acetate, and the like.

Further, the polycondensation reaction may be performed using conventional catalysts such as known catalysts such as titanium butoxide, tin 2-ethylhexanoate, dibutyltin oxide, tin acetate, zinc acetate, tin disulfide, antimony trioxide, germanium dioxide, and the like. The polymerization temperature and the catalyst amount are not particularly limited and may be suitably determined.

In order to increase strength of the crystalline polyester obtained in the esterification reaction, transesterification reaction, or condensation polymerization, a method in which all monomers are added all at once, a method in which a divalent monomer is reacted first to reduce a low molecular weight component and then a trivalent or higher monomer is added to react, or the like, may be used.

In the present invention, the reason why the low-temperature fixability of the toner is improved by using the crystalline polyester is considered as follows.

The reason is because crystalline polyester and amorphous polyester are compatible with each other to widen an interval between molecular chains of the amorphous polyester, thereby weakening intermolecular force, and thus a glass transition temperature (Tg) of the toner is greatly lowered and the melt viscosity is low.

In order to improve the compatibility of the crystalline polyester with the amorphous polyester, it is preferable to shorten the number of carbon atoms of the aliphatic diol and/or aliphatic dicarboxylic acid constituting the crystalline polyester, and to increase an ester group concentration, thereby increasing the polarity.

However, even in the case of a toner of which the glass transition temperature (Tg) greatly decreases, it is necessary to secure blocking resistance in the use, transportation, or the like, under high temperature and high humidity environment. To this end, when the toner is exposed under high temperature and high humidity, it is required to recrystallize the crystalline polyester in the compatible toner so that the glass transition temperature (Tg) of the toner is returned up to about the glass transition temperature (Tg) of the amorphous polyester resin.

Here, if the ester group concentration of the crystalline polyester is high and the compatibility of the amorphous polyester and the crystalline polyester is significantly high, it is difficult to recrystallize the crystalline polyester, and the blocking resistance of the toner tends to be lowered.

From the above, it is preferable that the aliphatic diol constituting the crystalline polyester has 6 or more and 12 or less carbon atoms and the aliphatic dicarboxylic acid has 6 or more and 12 or less carbon atoms, from the viewpoints of both low-temperature fixability and blocking resistance.

Further, in the present invention, the low-temperature fixability is further improved by using the wax dispersant and the crystalline polyester in combination.

In general, a plasticizer such as crystalline polyester enters gaps of the amorphous polyester as described above, and thus the amorphous polyester is inhibited from regularly orienting, thereby resulting in exhibition of a plasticizing effect. Therefore, in many cases, a plasticizer having bulky side chains exhibits useful properties.

Since the wax dispersant has a structural site derived from a bulky saturated alicyclic compound, it is presumed that the wax dispersant and the crystalline polyester interact with each other in the toner to become a plasticizer having a bulky side chain. Therefore, in the present invention, it is considered that by using the wax dispersant and the crystalline polyester in combination, the low-temperature fixability is further improved.

In the present invention, it is preferable that the binder resin contains an amorphous polyester. A content ratio of the amorphous polyester in the binder resin is preferably 50% by mass or more, more preferably 70% by mass or more, and further preferably 90% by mass or more.

The amorphous polyester, similar to the crystalline polyester, can be prepared by a conventional polyester synthesis method.

Examples of the monomers used in the preparation of the amorphous polyester may include polyvalent alcohols (divalent or trivalent or higher alcohols), polycarboxylic acids (divalent or trivalent or higher carboxylic acids), and acid anhydrides thereof or lower alkyl esters thereof.

Here, when a branched polymer is produced, it is effective to perform partial crosslinking in the molecule of the amorphous polyester. For this purpose, a polyfunctional compound having 3 or more valences may be used. In other words, as the monomer, a trivalent or higher carboxylic acid and an acid anhydride or a lower alkyl ester thereof and/or a trivalent or higher alcohol may be contained.

The polyvalent alcohol and polycarboxylic acid used in the preparation of the amorphous polyester may be exemplified as follows.

Examples of the divalent alcohol may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol represented by Formula (A) below and derivatives thereof; and diols represented by Formula (B) below:

(A)

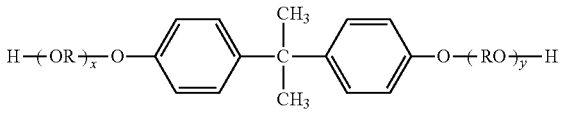

(In Formula, R is an ethylene or propylene group, x and y are each an integer of 0 or more, and an average value of x+y is 0 or more and 10 or less.)

(B)

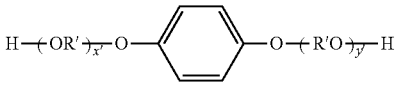

(In Formula, R' is —$CH_2CH_2$—, —$CH_2$—$CH(CH_3)$— or —$CH_2$—$C(CH_3)_2$—, x' and y' are each an integer of 0 or more, and an average value of x'+y' is 0 or more and 10 or less.)

Examples of the divalent carboxylic acid may include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, n-octyl succinic acid, isooctenyl succinic acid, and isooctyl succinic acid. Further, acid anhydrides and lower alkyl esters thereof may be used.

Among them, maleic acid, fumaric acid, terephthalic acid, adipic acid, and n-dodecenyl succinic acid are preferably used.

Examples of the trivalent or higher alcohol may include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropane triol, 2-methyl-1,2,4-butanetriol, trimethylolethane, trimethyolpropane, and 1,3,5-trihydroxymethylbenzene.

Among them, glycerol, trimethylol propane and pentaerythritol can be preferably exemplified.

Examples of the trivalent or higher carboxylic acid may include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxypropane, 1,2,4-cyclohexanetricarboxylic acid, tetra(methylenecarboxyl) methane, 1,2,7,8-octanetetracarboxylic acid, pyromellitic acid, and empol trimer acid. Further, acid anhydrides and lower alkyl esters thereof may be used.

Among them, 1,2,4-benzenetricarboxylic acid (trimellitic acid) or a derivative thereof is preferably used since it is inexpensive and it is easy to control its reactivity.

The divalent alcohol and the trivalent or higher alcohol may be used alone or a plurality of divalent alcohols and trivalent or higher alcohols may be used in combination. Similar to this, the divalent carboxylic acid and the trivalent or higher carboxylic acid may be used alone or a plurality of divalent carboxylic acids and trivalent or more carboxylic acids may be used in combination.

In the present invention, the amorphous polyester may be a hybrid resin. For example, a hybrid resin obtained by chemically bonding an amorphous polyester and a vinyl-based resin or a vinyl-based copolymer can be included.

In this case, a content ratio of the amorphous polyester in the hybrid resin is preferably 50% by mass or more, and more preferably 70% by mass or more.

As a method for producing a hybrid resin of an amorphous polyester and a vinyl-based resin or a vinyl-based copolymer, there is a method of performing a polymerization reaction of either one or both resins in a place where a polymer including a monomer component capable of reacting with each of a vinyl-based resin or a vinyl-based copolymer and a polyester is present.

Examples of the monomer capable of reacting with the vinyl-based resin or the vinyl-based copolymer among the monomers constituting the amorphous polyester may include unsaturated dicarboxylic acids such as phthalic acid, maleic acid, citraconic acid, itaconic acid, anhydride thereof, and the like.

Examples of the monomer capable of reacting with the amorphous polyester among the monomers constituting the vinyl-based resin or the vinyl-based copolymer may include monomers having a carboxy group or a hydroxy group, acrylic acid esters, or methacrylic acid esters.

Further, in the present invention, resins other than the amorphous polyester may be used as the binder resin to the extent that the effects of the present invention are not impaired.

The resin is not particularly limited, and examples of the resin may include resins used as a binder resin of a toner. Examples of the resin may include vinyl-based resins, phenol resins, natural resin-modified phenol resins, natural resin-modified maleic resins, acrylic resins, methacrylic resins, polyvinyl acetate resins, silicone resins, polyurethane, polyamide resins, furan resins, epoxy resins, xylene resins, polyvinyl butyral, terpene resins, coumarone-indene resins, petroleum resins, and the like.

It is preferable that a peak molecular weight is 4,000 or more and 13,000 or less in the molecular weight distribution measured by gel permeation chromatography (GPC) of the tetrahydrofuran (THF) soluble content of amorphous polyester. It is preferable to satisfy the above-described range from the viewpoint of low-temperature fixability and hot offset resistance.

Further, an acid value of the amorphous polyester is preferably 2 mgKOH/g or more and 30 mgKOH/g or less from the viewpoint of chargeability under a high temperature and high humidity environment.

Further, a hydroxyl group value of the amorphous polyester is preferably 2 mgKOH/g or more and 20 mgKOH/g or less from the viewpoint of low-temperature fixability and blocking resistance.

In the present invention, the amorphous polyester may contain a low molecular weight amorphous polyester C having a peak molecular weight of 4500 or more and 7000 or less and a high molecular weight amorphous polyester B having a peak molecular weight of 8500 or more and 9500 or less.

In this case, it is preferable that a mixing ratio (B/C) of the high molecular weight amorphous polyester B and the low molecular weight amorphous polyester C is 10/90 or more and 60/40 or less on a mass basis from the viewpoint of low-temperature fixability and hot offset resistance.

The peak molecular weight of the high molecular weight amorphous polyester B is preferably 8500 or more and 9500 or less from the viewpoint of hot offset resistance. Further, an acid value of the high molecular weight amorphous polyester B is preferably 10 mgKOH/g or more and 30 mgKOH/g or less from the viewpoint of chargeability under a high temperature and high humidity environment.

The peak molecular weight of the low molecular weight amorphous polyester C is preferably 4500 or more and 7000 or less from the viewpoint of low-temperature fixability. Further, an acid value of the low molecular weight amorphous polyester C is preferably 10 mgKOH/g or less from the viewpoint of chargeability under a high temperature and high humidity environment.

In addition, the acid value is the number of milligrams (mg) of potassium hydroxide which is required to neutralize an acid contained in 1 g of a sample. The acid value of the resin is measured in accordance with JIS K0070-1992.

In the present invention, the toner particles contain wax. The wax may be exemplified as follows.

Hydrocarbon-based waxes such as low molecular weight polyethylene, low molecular weight polypropylene, alkylene copolymers, microcrystalline wax, paraffin wax, and Fischer-Tropsch wax; oxides of a hydrocarbon-based wax such as an oxidized polyethylene wax or block copolymers thereof; waxes including fatty acid ester as a main component such as carnauba wax; and waxes obtained by deoxidizing some or all of fatty acid esters such as deacidified carnauba wax.

Further, the wax may be exemplified as follows. Saturated linear fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyvalent alcohols such as sorbitol; esters of fatty acids such as palmitic acid, stearic acid, behenic acid, and montanic acid with alcohols such as stearyl alcohol, aralkyl alcohol, behenyl alcohol, carnaubyl alcohol, ceryl alcohol and melissyl alcohol; fatty acid amides such as linoleic acid amide, oleic acid amide, and lauric acid amide; saturated fatty acid bisamides such as methylene bisstearic acid amide, ethylene biscapric acid amide, ethylene bislauric acid amide, and hexamethylene bisstearic acid amide; unsaturated fatty acid amides such as ethylene bis-oleic acid amide, hexamethylene bis-oleic acid amide, N,N'-dioleyl adipic acid amide and N,N' dioleyl sebacic acid amide; aromatic bisamides such as m-xylene bisstearic acid amide and N,N' distearyl isophthalic acid amide; aliphatic metal salts such as calcium stearate, calcium laurate, zinc stearate, and magnesium stearate (commonly referred to as metal soaps); waxes obtained by grafting an aliphatic hydrocarbon-based wax with a vinyl-based monomer such as styrene or acrylic acid; partial esters of fatty acid and polyvalent alcohol such as behenic acid monoglyceride; and methyl ester compounds having a hydroxy group obtained by hydrogenation of vegetable oil.

Among these waxes, the hydrocarbon-based waxes such as low molecular weight polypropylene, paraffin wax, and Fischer-Tropsch wax, or fatty acid ester-based waxes such as carnauba wax are preferable from the viewpoint of improving low-temperature fixability and hot offset resistance. In the present invention, the hydrocarbon-based wax is more preferable since hot offset resistance is further improved.

The content of the wax is preferably 1.0 part by mass or more and 20.0 parts by mass or less with respect to 100.0 parts by mass of the binder resin.

The relationship between contents of the wax and the wax dispersant (parts by mass) in the toner particles is preferably $0.5 \leq$(wax dispersant)/(wax)$\leq 2.5$, and more preferably $1.0 \leq$(wax dispersant)/(wax)$\leq 1.5$.

In addition, the peak temperature of the highest endothermic peak measured by a differential scanning calorimeter (DSC) of wax is preferably 45° C. or more and 140° C. or less, and more preferably 70° C. or more and 100° C. or less. When the peak temperature of the highest endothermic peak of the wax is satisfied within the above-described range, it is more preferable from the viewpoint of both blocking resistance and hot offset resistance of the toner.

The colorant according to the magenta toner is the same as described above, and the colorant used in the black toner, the cyan toner, and the yellow toner in the toner kit according to another embodiment of the present invention may be exemplified as follows.

Examples of the colorant for black toner may include carbon black; colorants making black colors using yellow colorant, magenta colorant, and cyan colorant. As the colorant, a pigment may be used alone. However, it is more preferable to use dye and the pigment in combination to improve clarity in view of an image quality of the full color image.

The pigment for cyan toner may be exemplified as follows: C.I. Pigment Blue 2, 3, 15: 2, 15: 3, 15: 4, 16, 17; C. I. Vat Blue 6; C. I. Acid Blue 45; and a copper phthalocyanine pigment in which 1 to 5 phthalimide methyl groups are substituted in a phthalocyanine skeleton.

An example of the dye for cyan toner may include C. I. Solvent Blue 70.

The pigment for yellow toner may be exemplified as follows: C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, 185; and C. I Vat Yellow 1, 3, 20.

An example of the dye for yellow toner is C. I. Solvent Yellow 162.

The content of the colorant is preferably 0.1 parts by mass or more and 30.0 parts by mass or less with respect to 100.0 parts by mass of the binder resin.

The toner particle may contain a charge control agent as required.

The charge control agent may be a known compound, but preferably a metal compound of an aromatic carboxylic acid which is colorless and capable of stably retaining a constant charge amount while having a high charging speed of the toner.

Examples of the negative-based charge control agent may include a salicylic acid metal compound, a naphthoic acid metal compound, a dicarboxylic acid metal compound, a polymer compound having a sulfonic acid or a carboxylic acid in a side chain, a polymer compound having a sulfonate or sulfonate ester in a side chain, a polymer compound having a carboxylic acid salt or a carboxylic acid ester compound in a side chain, a boron compound, an urea compound, a silicon compound, and calixarene.

Examples of the positive-based charge control agent may include a quaternary ammonium salt, a polymer compound having the quaternary ammonium salt in the side chain, a guanidine compound, and an imidazole compound.

The charge control agent may be internally or externally added to the toner particles.

The content of the charge control agent is preferably 0.2 part by mass or more and 10.0 parts by mass or less with respect to 100.0 parts by mass of the binder resin.

The toner may contain inorganic fine particles as required. The inorganic fine particles may be internally added to the toner particles or may be mixed with the toner particles, as an external additive.

When the inorganic fine particles are contained as the external additive, inorganic fine particles such as silica fine particles, titanium oxide fine particles and aluminum oxide fine particles are preferable.

It is preferable that the inorganic fine particles are hydrophobicized with a hydrophobic agent such as a silane compound, a silicone oil, or a mixture thereof.

When the inorganic fine particles are used for improving the fluidity of the toner, a specific surface area thereof is preferably 50 $m^2/g$ or more to 400 $m^2/g$ or less. Meanwhile, when the inorganic fine particles are used for improving durability of the toner, a specific surface area thereof is preferably 10 $m^2/g$ or more to 50 $m^2/g$ or less.

In order to achieve both improvement in flowability and improvement in durability, inorganic fine particles having a specific surface area within the above-described range may be used in combination.

When the inorganic fine particles are contained as an external additive, it is preferable that an amount of the inorganic fine particles is 0.1 part by mass or more and 10.0 parts by mass or less based on 100.0 parts by mass of the toner particles. The toner particles and the inorganic fine particles may be mixed using a known mixer such as a Henschel mixer.

The toner may be used as a one-component developer, but may be mixed with a magnetic carrier and used as a two-component developer in order to further improve dot reproducibility and to supply a stable image over a long period of time.

Examples of the magnetic carrier may include generally known magnetic carriers such as iron oxide; metal particles such as iron, lithium, calcium, magnesium, nickel, copper, zinc, cobalt, manganese, chromium and rare earth, alloy particles thereof, and oxide particles thereof; magnetic materials such as ferrite; magnetic material-dispersed resin carrier (so-called resin carrier) containing a magnetic material and a binder resin for retaining the magnetic material in a dispersed state; and the like.

When the toner is mixed with the magnetic carrier to be used as a two-component developer, a mixing ratio of the magnetic carrier and the toner is preferably adjusted so that a toner concentration in the two-component developer is 2% by mass or more and 15% by mass or less, and more preferably 4% by mass or more and 13% by mass or less.

In the present invention, a method of producing the toner particles is not particularly limited, but is preferably a melt-kneading method or an emulsion aggregation method in order to sufficiently exhibit the effect of the wax dispersant. In addition, from the viewpoint of wax dispersibility, it is more preferable to use the melt-kneading method.

Here, the melt-kneading method is a method for producing toner particles in which a melt-kneaded product is obtained by melting and kneading a mixture containing a binder resin, a crystalline polyester, a wax, and a wax dispersant (hereinafter simply referred to as a melt-kneading method). By producing the toner particles through the melt-kneading step, dispersibility of the wax is improved.

In the melt-kneading step, the raw material of the toner particles (in particular, the binder resin, the wax dispersant, and the wax) are firmly mixed by heat and shear, and thus dispersibility of the wax in the toner particles is improved. As a result, the wax is finely dispersed in the toner particles, and hot offset resistance is improved.

Further, even when the toner is left under high temperature and high humidity, the wax dispersant suppresses elution of the wax to a surface of the toner particles, and thus blocking resistance of the toner is improved and chargeability is not deteriorated.

In the present invention, in the method for producing toner particles, it is preferable to include a step (hereinafter also simply referred to as a heat treatment step) of heat-treating the resin particles obtained by cooling a melt-kneaded product obtained in the melt-kneading step, followed by pulverization. By performing the heat treatment step, the chargeability and blocking resistance are improved as compared to when the conventional wax dispersant is used.

Generally, when the heat treatment step is performed, since wax having high adhesion elutes on the surface of the toner particles, the blocking resistance of the toner is deteriorated, and a charging failure due to decrease in fluidity of the toner occurs.

However, when the toner particles containing the wax dispersant are heat-treated, since the hydrophobic wax dispersant is transferred to the surface of the toner particles at the same time as the wax, the fluidity of the toner does not decrease even under high temperature and high humidity, and thus the chargeability is not deteriorated. In addition, since the wax dispersant has a structural site derived from a bulky saturated alicyclic compound, elution of wax is suppressed at the time of the heat treatment to improve blocking resistance of the toner.

Hereinafter, a procedure for producing toner particles using the melt-kneading method is described.

First, in the raw material mixing step, predetermined amounts of a binder resin containing amorphous polyester, a colorant, a wax, a crystalline polyester, a wax dispersant for toner, and the like, as toner raw materials, are weighed, blended, and mixed.

Examples of a device used for the mixing may include Henschel mixer (manufactured by Nippon Coke & Engineering Co., Ltd.); Super mixer (manufactured by Kawata Mfg Co., Ltd.); Ribocone (manufactured by Okawara Mfg Co., LTD.); Nauta Mixer, Turbulizer, and Cyclomix (manufactured by Hosokawa Micron Corporation); Spiral pin mixer (manufactured by Pacific Machinery & Engineering Co., Ltd.); and Loedige mixer (manufactured by Matsubo Corporation).

Then, the obtained mixture is melted and kneaded, the resins are melted, and a colorant, a wax, a wax dispersant for toner, and the like, are dispersed in the melted resins (melt-kneading step).

Examples of a device used for the melt-kneading may include TEM type extruder (manufactured by Toshiba Machine Co., Ltd.); TEX biaxial kneader (manufactured by The Japan Steel Works, Ltd.); PCM kneader (manufactured by Ikegai Ironworks Corp.); Kneadex (manufactured by Mitsui Mining Co., Ltd.), and the like. Due to the superiority of continuous production possibility, or the like, it is preferable to use a continuous type kneader such as a uniaxial or biaxial extruder rather than a batch type kneader.

Then, the obtained melt-kneaded product is rolled by two rolls, or the like, and cooled by water cooling or the like.

The obtained cooled product is pulverized to a desired particle size. First, the product is coarsely crushed with a crusher, a hammer mill, a feather mill, or the like, and then finely crushed with the Krypton system (manufactured by Kawasaki Heavy Industries, Ltd.), Super rotor (manufactured by Nisshin Engineering Inc.), and the like, thereby obtaining resin particles.

The obtained resin particles may be classified to a desired particle size, and may be used as toner particles. Examples of a device used for classification may include Turboplex, Faculty, TSP, TTSP (manufactured by Hosokawa Micron Corporation); Elbow-Jet (manufactured by Nittetsu Mining Co., Ltd.); and the like.

In addition, the obtained resin particles may be subjected to heat treatment to be used as toner particles.

In addition, when coarse particles are present after the heat treatment, the coarse particles may be removed by classifying or sieving as necessary. A device used for classification may include the above-described device. Meanwhile, a device used in the sieving may include Ultrasonic (Koei Sangyo Co., Ltd.); Resonasieve, and Gyro-Sifter (Tokuju Corporation); Turbo Screener (Turbo Kogyo Co., Ltd.); Hi-Bolter (manufactured by Toyo Hitec Co., LTD.); and the like.

Meanwhile, inorganic fine particles or the like may be added to the obtained resin particles as needed before the heat treatment step.

Hereinafter, a method of heat-treating the resin particles using a heat treatment apparatus shown in FIG. 1 is specifically described.

Resin particles quantitatively supplied by a raw material quantitative supply unit 1 are introduced into an introduction pipe 3 installed on a vertical line of the raw material supply unit by compressed gas adjusted by a compressed gas flow rate adjustment unit 2. A mixture that passes through the introduction pipe 3 is uniformly dispersed by a conical protruding member 4 provided in a central portion of the raw material supply unit, and is introduced into a 8-way supply pipe 5 extending in the radial direction to be introduced into a processing chamber 6 for heat treatment.

Here, the flow of the resin particles supplied to the processing chamber 6 is restricted by a regulating unit 9 for regulating the flow of the resin particles provided in the processing chamber 6. Therefore, the resin particles supplied to the processing chamber 6 are subjected to heat treatment while swirling in the processing chamber 6, and then cooled.

Hot air for heat treatment of the supplied resin particles is supplied from a hot air supply unit 7, distributed in a distributing member 12, and is introduced by being spirally swirled into the processing chamber 6 by a swirling member 13 for swirling hot air. As a constitution thereof, the swirling member 13 for swirling hot air has a plurality of blades, and it is possible to control the swirling of hot air according to the number and angle thereof (further, reference numeral 11 denotes an outlet of hot air supply unit). The temperature at the outlet of the hot air supply unit 7 of the hot air supplied into the processing chamber 6 is preferably 100° C. or more and 300° C. or less, and more preferably 130° C. or more and 170° C. or less. When the temperature at the outlet of the hot air supply unit 7 is within the above-described range, it is possible to uniformly treat the particles while preventing fusion and coalescence of the particles due to excessive heating of the resin particles.

Hot air is supplied from the hot air supply unit 7. Further, the heat-treated resin particles which are heat-treated are cooled by cooled air supplied from a cool air supply unit 8. The temperature of the cool air supplied from the cool air supply unit 8 is preferably −20° C. or more and 30° C. or less. When the temperature of the cool air is within the above-described range, it is possible to efficiently cool the heat-treated resin particles and to prevent fusion and coalescence of the heat-treated resin particles without hindering the uniform heat treatment of the resin particles. In addition, the absolute moisture content of cool air is preferably 0.5 $g/m^3$ or more and 15.0 $g/m^3$ or less.

Next, the cooled heat-treated resin particles are recovered by a recovering unit 10 at a lower end of the processing chamber 6. Further, a blower (not shown) is provided at the tip of the recovering unit 10 and is configured to suck and transport the particles.

In addition, a powder particle supply port 14 is provided so that a swirling direction of the supplied resin particles and a swirling direction of the hot air are in the same direction, and the recovering unit 10 is also provided in a tangential direction on an outer peripheral portion of the processing chamber 6 so as to maintain a swirling direction of the swirled resin particles. Further, the cool air supplied from the cool air supply unit 8 is configured to be supplied in a horizontal direction and in a tangential direction from an outer peripheral portion of the apparatus to an inner peripheral surface of the processing chamber. A swirling direction of the resin particles before the heat treatment supplied from the powder particle supply port 14, a swirling direction of the cool air supplied from the cool air supply unit 8, and a swirling direction of the hot air supplied from the hot air supply unit 7 are all the same directions. Therefore, turbulence does not occur in the processing chamber, a swirling flow in the apparatus is strengthened, a strong centrifugal force is applied to the resin particles before heat treatment, and dispersibility of the resin particles before heat treatment is further improved, and thus it is possible to obtain heat-treated resin particles with few coalesced particles and uniform shapes.

Hereinafter, methods for measuring various physical properties of the toner and the raw materials are described.

<Measurement of Glass Transition Temperature (Tg) of Resin>

The glass transition temperature of the resin is measured according to ASTM D3418-82 using a differential scanning calorimeter "Q2000" (manufactured by TA Instruments).

The melting point of indium and zinc is used for the temperature correction of the apparatus detection part, and the heat of melting of indium is used for correction of the quantity of heat.

Specifically, about 5 mg of the resin is precisely weighed and placed in an aluminum pan. As a reference, an empty aluminum pan is used. These aluminum pans are used to perform measurement at a heating rate of 10° C./min and a cooling rate of 10° C./min within a measurement range of 30° C. or more and 180° C. or less.

The temperature is once raised to 180° C. and maintained for 10 minutes, and continuously lowered to 30° C., and then the temperature is raised again. In this second temperature raising process, a specific heat change is obtained in the temperature range of 30° C. to 100° C. A temperature at the point where a straight line which is equidistant in a vertical axis direction from a straight line extending a base line before and after the specific heat change appears intersects a curve of the step-type change part of the glass transition in the DSC curve is referred to as a glass transition temperature (Tg: ° C.) of the resin.

<Measurement of Peak Temperature of Endothermic Peak of Wax and Crystalline Polyester Resin>

The peak top temperature of the highest endothermic peak of the wax and the crystalline polyester resin are measured according to ASTM D3418-82 using a differential scanning calorimeter, "Q1000" (manufactured by TA Instruments).

The melting point of indium and zinc is used for the temperature correction of the apparatus detection part, and the heat of melting of indium is used for correction of the quantity of heat.

Specifically, approximately 5 mg of a sample is precisely weighed, placed into a silver pan, and measured once. As a reference, a silver empty pan is used. Measurement conditions are as follows.

Heating rate: 10° C./min

Measurement start temperature: 20° C.

Measurement end temperature: 180° C.

In the case of using the toner as a sample, when the endothermic peak (endothermic peak derived from the binder resin) does not overlap with the endothermic peak of the resin other than the wax and the crystalline resin, the obtained highest endothermic peak is directly regarded as an endothermic peak derived from the wax and the crystalline resin.

Meanwhile, in the case of using the toner as a sample, the endothermic peak of the wax and the endothermic peak of the crystalline resin can be distinguished by extracting the wax from the toner by Soxhlet extraction using a hexane solvent, conducting a differential scanning calorimetric measurement of wax alone, and comparing the obtained endothermic peak of the wax and the endothermic peak of the toner.

In addition, the highest endothermic peak means a peak at which the endotherm becomes maximum when there are a plurality of peaks. Further, the peak temperature of the highest endothermic peak is set as the melting point.

<Measurement of Weight Average Molecular Weight (Mw)>

The molecular weight distribution of the wax dispersant, and the like, is measured by gel permeation chromatography (GPC) as follows.

First, the sample is placed in tetrahydrofuran (THF), allowed to stand at 25° C. for several hours, sufficiently shaken, mixed well with THF, and allowed to stand for 12 hours or more until there is no coalescence of the sample.

At this time, time to allow the sample to stand in the THF is set to be 24 hours. Thereafter, the obtained solution is passed through a sample treatment filter (pore size of 0.2 μm or more and 0.5 μm or less, for example, My-Short disk H-25-2 (manufactured by Tosoh Corporation)) and is used as a sample for GPC.

Further, the concentration of the sample is adjusted to be 0.5 mg/ml or more and 5.0 mg/ml or less. This sample solution is used and the weight average molecular weight is measured under the following conditions.

The column is stabilized in a heat chamber at 40° C., tetrahydrofuran (THF) as a solvent is flowed at a flow rate of 1 ml per minute to the column at this temperature, and about 100 μl of the sample solution is injected to measure the weight average molecular weight.

As the column, a plurality of commercially available polystyrene gel columns are combined. A combination of shodex GPC KF-801, 802, 803, 804, 805, 806, 807, and 800P manufactured by Showa Denko K.K. or a combination of TSKgel G1000H($H_{XL}$), G2000H($H_{XL}$), G3000H($H_{XL}$), G4000H($H_{XL}$), G5000H($H_{XL}$), G6000H($H_{XL}$), G7000H ($H_{XL}$), and TSKgurd column manufactured by Tosoh Corporation is used.

In the measurement of the molecular weight of the sample, the molecular weight distribution of the sample is calculated from the relationship between the logarithmic value and the count value of the calibration curve prepared by several kinds of monodisperse polystyrene standard samples.

As standard polystyrene samples for preparing a calibration curve, at least 10 standard polystyrene samples in which a molecular weight is about $1\times10^2$ to $1\times10^7$ manufactured by Tosoh Corporation or by Showa Denko K. K., are used. In addition, a detector is an RI (refractive index) detector.

<Measurement of Weight Average Particle Diameter (D4) of Toner Particle>

Weight average particle diameter (D4) of the toner particles is measured with 25,000 effective measurement channels using a precision particle size distribution measuring apparatus "Coulter Counter Multisizer 3" (registered trademark, manufactured by Beckman Coulter, Inc.) equipped with a 100 μm aperture tube by a pore electrical resistance method and dedicated software "Beckman Coulter Multisizer 3 Version 3.51" (manufactured by Beckman Coulter, Inc.) attached to set measurement conditions and analyze measurement data, and calculated by analyzing the measured data.

As an aqueous electrolyte solution used in the measurement, an aqueous solution obtained by dissolving special grade sodium chloride in ion-exchange water so as to have a concentration of about 1% by mass, e.g., "ISOTON II" (manufactured by Beckman Coulter, Inc.) can be used.

In addition, before the measurement and the analysis, the dedicated software is set as described below.

On the "standard operation mode (SOM) setting screen" of the dedicated software, a total count number in control mode is set to 50,000 particles, the number of measurements is set to 1, and a Kd value is set to a value obtained using "standard particles of 10.0 μm" (manufactured by Beckman Coulter, Inc.). A threshold value and a noise level are automatically set by pressing a threshold/noise level measurement button. Further, a current is set to 1,600 μA, a gain is set to 2, and the electrolyte solution is set to ISOTON II. Then, "flushing of aperture tube after measurement" is checked.

On the "conversion setting screen of pulse to particle diameter" of the dedicated software, a bin interval is set to the logarithmic particle diameter, a particle diameter bin is set to 256 particle diameter bins, and a particle diameter range is set to 2 μm or more and 60 μm or less.

Specific measurement methods are as follows.

(1) A 250 ml round bottom glass beaker exclusive for Multisizer 3 is charged with about 200 ml of the aqueous electrolyte solution, and then placed in a sample stand. Then, the mixture was stirred with a stirrer rod counterclockwise at 24 revolutions per second. Then, dirt and air bubbles in the aperture tube are removed by the "flushing of aperture" function of the dedicated software.

(2) A 100 ml of flat bottom glass beaker is charged with 30 ml of the aqueous electrolyte solution. Into the aqueous electrolyte solution, about 0.3 ml of a diluted solution is added in which "Contaminon N" (a 10% by mass aqueous solution of a neutral detergent for washing a precision measuring instrument, consisting of a nonionic surfactant, an anion surfactant, and an organic binder, having a pH of 7, manufactured by Wako Pure Chemical Industries, Ltd.) as a dispersant is diluted 3-fold by mass with ion-exchange water.

(3) An ultrasonic wave disperser "Ultrasonic Dispersion System Tetora 150" (manufactured by Nikkaki-Bios Co., Ltd.) in which two oscillators having an oscillation frequency of 50 kHz are embedded in a phase-shifted state at 180 degrees, and which has an electrical output of 120 W is prepared. A water tank of the ultrasonic wave disperser is charged with a predetermined amount of ion-exchange water, and about 2 ml of Contaminon N is added to the water tank.

(4) The beaker in (2) above is set in a beaker-holding hole in the ultrasonic wave disperser, and the ultrasonic wave disperser is actuated. In addition, a height position of the beaker is adjusted so that a resonance state of a liquid level of the aqueous electrolyte in the beaker is highest.

(5) In a state where the aqueous electrolyte solution in the beaker in (4) above is irradiated with ultrasonic waves, about 10 mg of the toner particles are added little by little and dispersed in the aqueous electrolyte solution. In addition, the ultrasonic dispersion treatment is further continued for 60 seconds. Further, during the ultrasonic dispersion, a water temperature of the water tank is appropriately controlled to be 10° C. or more and 40° C. or less.

(6) The aqueous electrolyte solution in (5) above in which the toner is dispersed is added dropwise using a pipette to the round bottom beaker in (1) placed in the sample stand, and then a measurement concentration is adjusted to be about 5%. Then, the measurement is performed until the number of measured particles reaches 50,000.

(7) The measured data is analyzed by the dedicated software attached to the apparatus, thereby calculating the weight average particle diameter (D4). Further, the weight average particle diameter (D4) is an "average diameter" on the analysis/volume statistic value (arithmetic mean) screen in the setting of graph/vol % in the dedicated software.

<Measurement of Acid Value of Wax Dispersant>

The acid value of the wax dispersant is measured by the following method. The acid value is the number of milligrams (mg) of potassium hydroxide which is required to neutralize an acid contained in 1 g of a sample and measured in accordance with JIS K 0070-1992. Specifically, the measurement is performed in the following order.

(1) Preparation of Reagent

First, 1.0 g of phenolphthalein is dissolved in 90 mL of ethyl alcohol (95% by volume), and deionized water is added so as to have a volume of 100 mL, thereby obtaining a phenolphthalein solution.

Then, 7 g of special grade potassium hydroxide is dissolved in 5 mL of deionized water and ethyl alcohol (95% by volume) is added to have a volume of 1 L. The resultant solution is added in an alkali-resistant container and left for 3 days so as not to touch carbonic acid gas, or the like, and filtered to obtain a potassium hydroxide solution. The obtained potassium hydroxide solution is stored in an alkali-resistant container. The factor of the potassium hydroxide solution is determined by taking 0.1 mol/L hydrochloric acid 25 mL into an Erlenmeyer flask, adding a few drops of the phenolphthalein solution, titrating with the potassium hydroxide solution, and calculating an amount of the potassium hydroxide solution consumed for neutralization. The above 0.1 mol/L hydrochloric acid is prepared in accordance with JIS K 8001-1998.

(2) Operation (A) Main Test

First, 2.0 g of the wax dispersant sample is precisely weighed in a 200 mL Erlenmeyer flask, 100 mL of a mixed solution of toluene and ethanol (4:1) is added thereto, and the mixture is dissolved over 5 hours. Then, several drops of the phenolphthalein solution are added as an indicator and the obtained mixture is titrated with the potassium hydroxide solution. In addition, the end point of the titration is set as the time when the light red color of the indicator was continued for about 30 seconds.

(B) Blank Test

Titration is performed in the same manner as the above operation except that the sample is not used (i.e., only a mixed solution of toluene:ethanol (4:1) is used).

(3) The acid value is calculated by substituting the obtained result into the following Equation.

$$A=[(C-B)\times f\times 5.61]/S$$

Here, A is an acid value (mgKOH/g), B is an addition amount (mL) of potassium hydroxide solution in blank test, C is an addition amount (mL) of potassium hydroxide solution in main test, f is a factor of a potassium hydroxide solution, and S is a sample (g).

<Measurement of Content of Colorant in Toner>

To measure the content of the colorant in the toner, the measuring apparatus "RINT-TTRII" (manufactured by Rigaku Corporation) and the control software and analysis software attached to the apparatus are used for the X-ray diffraction apparatus using the X-ray diffraction measurement.

Measurement conditions are as follows.

X-ray: Cu/50 kV/300 mA
Goniometer: Rotor horizontal goniometer (TTR-2)
Attachment: Standard sample holder
Divergence slit: Release
Divergence vertical restriction slit: 10.00 mm
Scattering slit: Open
Receiving slit: Open
Counter: Scintillation counter
Scan mode: Continuous
Scan speed: 4.0000°/min.
Sampling width: 0.0200°
Scan axis: 2 θ/θ
Scan range: 10.0000 to 40.0000°

Subsequently, the target toner is set on the sample plate and the measurement is started. The content of the colorant in the toner is calculated by performing measurement in the range of the Bragg angle (2θ±0.20 deg) of 3 degrees to 35 degrees in the CuKα characteristic X-ray and subtracting the integrated intensity of the spectrum other than the colorant from the total integrated intensity of the obtained spectrum.

<Evaluation of Crystalline State of Crystalline Polyester by TEM Observation>

Observation of the cross-section of the toner by a transmission electron microscope (TEM) and evaluation of the crystalline polyester domain can be performed as follows.

The cross-section of the toner is subjected to ruthenium dyeing to obtain the crystalline polyester resin with a clear contrast. The crystalline polyester resin is dyed more weakly than the organic components constituting the inside of the toner. This is considered to happen because permeation of the dyeing material into the crystalline polyester resin is weaker than the organic component in the toner due to a difference in density, and the like.

Since the amount of ruthenium atoms varies depending on intensity of dyeing, a strongly dyed portion contains a number of these atoms to be black on the observation image since an electron beam is not transmitted through the strongly dyed portion, and a weakly dyed portion becomes white on the observed image since the electron beam is easily transmitted through the weakly dyed portion.

An Os film (5 nm) and a naphthalene film (20 nm) as protective films were added to the toner using an osmium plasma coater (Filgen, Inc., OPC80T), the toner was embedded in a photocurable resin D800 (JEOL Ltd.), and then a toner cross-section having a thickness of 60 nm (or 70 nm) was produced at a cutting speed of 1 mm/s by an Ultra Microtome (Leica, UC7).

The obtained cross-section was dyed for 15 minutes in a $RuO_4$ gas 500 Pa atmosphere using a vacuum electron dyeing apparatus (Filgen, Inc. VSC4R1H), and STEM observation was performed using TEM (JEOL Ltd., JEM 2800).

A probe size of the STEM was 1 nm, and an image size was 1024×1024 pixels.

The obtained image is binarized (threshold 120/255 step) with an image processing software "Image-Pro Plus" (manufactured by Media Cybernetics).

Figure 2:
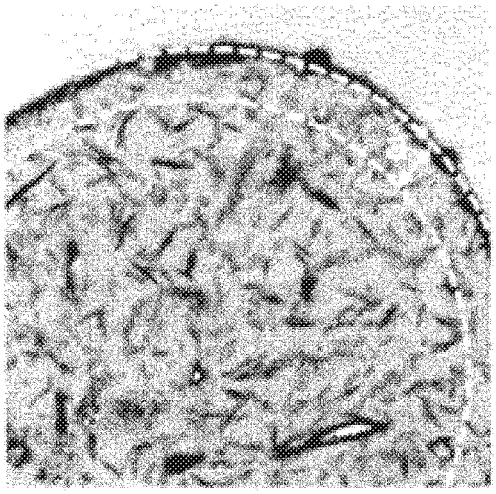
FIG. 2 is a distribution diagram of crystals of crystalline polyester in a cross-section of a toner of the present invention by an electron beam transmission microscope.

The obtained cross-sectional image before binarization is shown in FIG. 2. As shown in FIG. 2, the crystalline domain of the crystalline polyester can be confirmed to be black with a needle shape, the crystal domain is extracted by binarizing the obtained image, and the size is measured. In the present invention, when observing cross-sections of 20 randomly selected toners, if the toner is the magenta toner, the maximum length of the crystalline polyester crystal domains of which length can be measured is measured, and if the toner is the other toners, the total number of the long axis and the short axis of the crystalline polyester crystal domains of which length can be measured is measured, and the arithmetic mean thereof (number average) is calculated.

Figure 3:
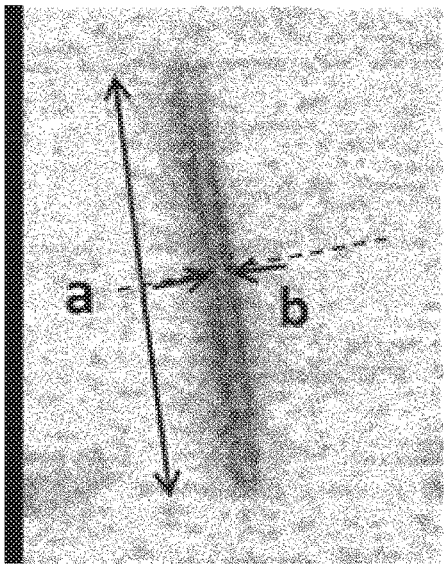
FIG. 3 is a view illustrating a long axis length and a short axis length of the crystalline polyester on the cross-section of the toner of the present invention by the electron beam transmission microscope.

Here, the maximum length of the crystalline domain of the crystalline polyester is defined as the distance between the two straight lines when the domain is interposed so as to be in contact with two parallel straight lines and the interval between the two straight lines is the maximum. As shown in FIG. 3, the long axis length of the crystalline domain of the crystalline polyester is the longest distance (a in FIG. 3) in the crystal domain of the cross-sectional image, and the short axis length is the shortest distance (b in FIG. 3) at the midpoint position of the long axis of the crystal.

In addition, the needle shape in the present invention means a shape which is thin and long and has a high degree of straightness, and a shape in which a short axis length is 25 nm or less while simultaneously being an aspect ratio of 3 or more, and simultaneously a gap of the crystal contour from the straight line is within 100% of the short axis length of the crystal when connecting center points, which are positioned in the short axis direction at both short sides in the long axis direction of the crystal, with a straight line.

According to the present invention, there are provided a magenta toner and a toner kit having excellent low-temperature fixability and hot offset resistance and superior coloring power.

EXAMPLE

Hereinafter, the present invention is described in more detail with reference to Preparation Examples and Examples, but these Preparation Examples and Examples do not limit the present invention at all. In addition, all of the number of parts in the following blendings is on a mass basis unless otherwise specified.

<Preparation of Compound (1)>

First, 50 parts of 3-hydroxy-4-methoxybenzanilide were uniformly dispersed in 1,000 parts of water, the mixture was cooled to 0 to 5° C. with ice and stirred at a high speed while slowly adding dropwise a 35% aqueous solution of HCl in an amount of 60 parts, and the mixture was continuously stirred strongly for 20 minutes. Thereafter, 50 parts of a 30% aqueous solution of sodium nitrite was added, the mixture was stirred for 60 minutes, then 2 parts of sulfamic acid was added, and a nitrous acid was removed. Further, 50 parts of sodium acetate and 75 parts of 90% acetic acid were added to prepare a diazonium salt solution.

Separately, 50 parts of N-phenyl-2-naphthalenecarboamide was dissolved together with 1,000 parts of water and 25 parts of sodium hydroxide at 80° C. or less, and 3 parts of sodium alkylbenzenesulfonate was added to prepare a coupler solution. The diazonium salt solution was added at a time under strong stirring while the coupler solution was maintained at 10° C. or lower. After the addition, the stirring was continued gently until the coupling reaction was completed, and the resultant product was heated to 120° C. and filtered to obtain Compound (1).

<Preparation Example of Colorant 1>

Ion-exchange water 1,500 parts

Compound (1) 100.0 parts

The above materials were stirred and mixed to suspend the compound (1) in water. Thereafter, 15.0 parts of tetrahydroabietic acid, 5.0 parts of abietic acid, and 30 parts of a 33% concentration of aqueous solution of sodium hydroxide were added. After raising the liquid temperature to 98° C., the mixture was stirred for 1 hour while maintaining the temperature. After cooling to 65° C., about 60 parts of 31% concentration of hydrochloric acid was added to precipitate the resin. The precipitated composition was separated by filtration, washed with ion-exchange water, and dried to obtain Colorant 1.

<Preparation Example of Colorant 2>

Colorant 2 was prepared in the same manner as in Preparation Example of Colorant 1 except that the type of the compound was changed as shown in Table 1.

<Preparation Example of Colorants 3 and 4>

In a pressurized reactor autoclave, 30.00 parts of dried dimethylsuccinylo succinate (1,4-cyclohexanedione-2,5-dicarboxylic acid methyl ester), 7.00 parts of aniline, 22.00 parts of p-toluidine, 300.00 parts of methanol, and 1.00 part of hydrochloric acid (35% by mass) were added.

The autoclave was sealed and flushed with nitrogen gas, and an internal pressure of the autoclave was maintained at a gauge pressure of 9.8 kPa (0.1 kg/cm$^2$). While stirring the mixture, the temperature in the autoclave was raised from 25° C. to 85° C. at a heating rate of 4.0° C./min, and the mixture was reacted at 85° C. for 5 hours.

Then, when the reaction mixture was cooled to 30° C. or less, the pressure was released to set the atmospheric pressure. Thereafter, the cooling was continued, and the temperature inside the autoclave was kept at 25° C.

Then, 40.00 parts of sodium hydroxide aqueous solution (50% by mass) and 34.60 parts of sodium m-nitrobenzenesulfonate were added to an autoclave and sealed.

The mixture was stirred for 10 minutes, the temperature in the autoclave was raised from 25° C. to 85° C. at a heating rate of 4.0° C./min, and the mixture was allowed to react for 5 hours. The mixture was then cooled to 30° C. or less and filtered to remove all solids.

The remaining solution was heated to 40° C. while stirring, 18.00 parts of hydrochloric acid (35% by mass) was added dropwise, and the mixture was maintained at this temperature for 30 minutes. Thereafter, the mixture was filtered, and the obtained filter cake was washed with a mixture of water/methanol (1/1 volume ratio) and cold water, followed by drying to obtain a product.

Then, 250.00 parts of polyphosphoric acid containing $P_2O_5$ (85.0% by mass) was added to the stirring vessel, and the temperature was raised while stirring and maintained at 90° C. Next, 45 parts of the mixture of the above-described intermediate was added, and the mixture was heated at 130° C. for 3 hours to perform a ring closure reaction. The mixture was cooled to 110° C. and 6 parts of water was added slowly over 10 minutes.

Thereafter, the mixture was poured into 750 parts of water at 50° C. and stirred at 60° C. for 1.5 hours. The solid was collected by filtration and washed with water until the washing water was neutral.

Then, 100 parts of the obtained press cake was re-slurried in 170 parts of methanol, and the slurry was heated in a pressure-resistant reactor at 90° C. for 3 hours. The mixture was cooled and the pH was adjusted to a range of 9.0 to 9.5 with sodium hydroxide solution (50% by mass).

The solid was collected by filtration and washed with water. The wet press cake was dried in an oven at 80° C. to obtain Colorant 3. In addition, Colorant 4 was obtained in the same manner as in the preparation of Colorant 3 except that the type of the compound was changed as shown in Table 1.

<Preparation Example of Colorant 5>

First, 48 parts of 3-amino-4-methoxybenzanilide was dispersed in 1,000 parts of water, 60 parts of 35% dilute hydrochloric acid was added at a temperature of 5° C. or less, and the mixture was stirred for 20 minutes. Thereafter, 50 parts of a 30% aqueous solution of sodium nitrite was added, the mixture was stirred for 60 minutes, then 2 parts of sulfamic acid was added and the excess nitrous acid was removed and separated. Then, 50 parts of sodium acetate and 75 parts of 90% acetic acid were added to prepare a diazonium salt solution.

Separately, under the temperature condition of 5° C. or less, 35 parts of Compound (1) and 19 parts of the compound shown in Table 1 (naphthol-based compound A) were dissolved in 1,000 parts by mass of water together with 25 parts of sodium hydroxide, then an aqueous solution of calcium chloride, and an alkylbenzenesulfonic acid, which is an anionic surfactant as a particle size adjuster of the pigment composition, were added in an appropriate amount to prepare an aqueous coupler solution.

Then, the aqueous solution of the diazonium salt was added at a time to the aqueous coupler solution while stirring, and the coupling reaction was performed under the condition of pH 5 while maintaining the temperature at 5° C. or less.

Further, a solution obtained by dissolving 10 parts of abietic acid in 200 parts of a 0.1 mol/L aqueous solution of sodium hydroxide was added and the mixture was sufficiently stirred to complete a laking reaction, followed by heat aging treatment at a temperature of 90° C. or higher to obtain a crude pigment composition.

After the crude pigment composition was separated by filtration, the obtained pigment composition cake was redispersed in an aqueous sodium hydroxide solution and subjected to alkali washing. After the alkali washing, the crude pigment composition was recovered by filtration and sufficiently washed with water. This operation was repeated several times, then the composition was dried at a high temperature and subjected to fine pulverization, thereby obtaining Colorant 5 which is a solid solution pigment containing Compound (1) treated with calcium abietate and the naphthol-based compound A as main components.

<Preparation Example of Colorant 6>

The compound represented by Colorant 3 in Table 1 was cyclized in phosphoric acid to produce 2,9-dimethylquinacridone. A phosphoric acid having 2,9-dimethylquinacridone was dispersed in water, subsequently the 2,9-dimethylquinacridone was separated by filtration, and the crude 2,9-dimethylquinacridone (C.I. Pigment Red 122) which is wetted with water was prepared. Further, meanwhile, the compound represented by Colorant 4 in Table 1 was cyclized in phosphoric acid to produce an unsubstituted quinacridone. The phosphoric acid having quinacridone was dispersed in water, and then the quinacridone was separated by filtration to prepare a crude unsubstituted quinacridone (C.I. Pigment Violet 19) wetted with water.

Then, 66 parts of the crude 2,9-dimethylquinacridone and 34 parts of the crude quinacridone were added to a vessel equipped with a condenser having a mixture of 600 parts of water and 300 parts of ethanol, and the mixture was heated and refluxed for 5 hours while grinding 2,9-dimethylquinacridone and quinacridone. After cooling, the solid solution pigment was separated by filtration, washed, and redispersed again in 2,000 parts of water, and an aqueous solution of sodium abietate was further added. After thoroughly stirring, an aqueous calcium chloride solution was added, and the mixture was heat-treated at 90° C. while stirring, repeatedly separated by filtration and washed, followed by drying and pulverization, thereby obtaining Colorant 6 as a quinacridone solid solution pigment treated with a rosin compound.

| | | | Constitution of compound | | | | | | | Mixing |
|---|---|---|---|---|---|---|---|---|---|---|
| Colorant | Type of colorant | Basic structure of compound | R1 | R2 | R3 | R4 | R5 | R6 | R7 | ratio |
| 1 | | Compound (1) | | | | | | | | |
| 2 | Pigment mainly including naphthol based compound A as main component | 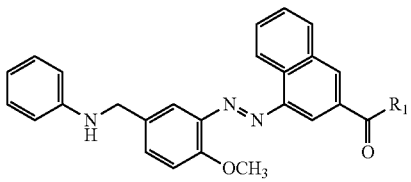 | —NH2 | | | | — | | | |

-continued

| Colorant | Type of colorant | Basic structure of compound | Constitution of compound R1 | R2 | R3 | R4 | R5 | R6 | R7 | Mixing ratio |
|---|---|---|---|---|---|---|---|---|---|---|
| 3 | Pigment mainly including quinacridone-based compound B as main component | 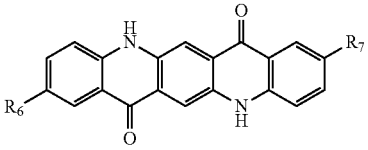 | | | — | | —CH3 | | —CH3 | |
| 4 | Pigment mainly including quinacridone-based compound C as main component | | | | — | | H | | H | |
| 5 | Solid solution pigment including Compound (1) and naphthol-based compound A as main components | | | | | | | | | Compound (1): A = 70:30 |
| 6 | Solid solution pigment including quinacridone-based compound B and quinacridone-based compound C | | | | | | | | | B:C = 80:20 |

<Preparation Example of Amorphous Polyester>

<Preparation Example of Low Molecular Weight Amorphous Polyester (L)>

| | |
|---|---|
| Polyoxypropylene (2.8)-2,2-bis(4-hydroxyphenyl) propane (0.17 mol; 100.0 mol % with respect to the total number of moles of polyvalent alcohol) | 76.6 parts |
| Terephthalic acid (0.10 mol; 72.0 mol % with respect to the total number of moles of polyvalent carboxylic acid) | 17.4 parts |
| Adipic acid (0.04 mol; 28.0 mol % with respect to the total number of moles of polyvalent carboxylic acid) | 6.0 parts |
| Titanium tetrabutoxide (esterification catalyst) | 0.5 parts |

The above materials were added to a reaction vessel equipped with a cooling tube, a stirrer, a nitrogen inlet tube, and a thermocouple.

Subsequently, the inside of the reaction vessel was replaced with nitrogen gas, the temperature was gradually raised with stirring, and the reaction was performed for 4 hours while stirring at a temperature of 200° C.

Further, the pressure in the reaction vessel was lowered to 8.3 kPa, maintained for 1 hour, cooled to 180° C., and returned to atmospheric pressure (first reaction step).

| | |
|---|---|
| tert-Butyl catechol (polymerization inhibitor) | 0.1 parts |

Thereafter, the above materials were added, the pressure in the reaction vessel was lowered to 8.3 kPa, the reaction was performed for 1 hour while the temperature was maintained at 180° C. After it was confirmed that the reaction product had a softening point of 90° C. measured according to ASTM D36-86, the temperature was lowered and the reaction was stopped (second reaction step) to obtain amorphous polyester (L). The obtained amorphous polyester (L) had a peak molecular weight (Mp) of 5,000, a softening point (Tm) of 90° C., and a glass transition temperature (Tg) of 52° C.

<Preparation Example of High Molecular Weight Amorphous Polyester (H)>

| | |
|---|---|
| Polyoxyethylene (2.2)-2,2-bis(4-hydroxyphenyl) propane (0.20 mol; 100.0 mol % with respect to the total number of moles of polyvalent alcohol) | 72.2 parts |

-continued

| | |
|---|---|
| Terephthalic acid (0.08 mol; 48.0 mol % with respect to the total number of moles of polyvalent carboxylic acid) | 13.2 parts |
| Adipic acid (0.06 mol; 34.0 mol % with respect to the total number of moles of polyvalent carboxylic acid) | 8.2 parts |
| Titanium tetrabutoxide (esterification catalyst) | 0.5 parts |

The above materials were added to a reaction vessel equipped with a cooling tube, a stirrer, a nitrogen inlet tube, and a thermocouple.

Subsequently, the inside of the reaction vessel was replaced with nitrogen gas, the temperature was gradually raised with stirring, and the reaction was performed for 2 hours while stirring at a temperature of 200° C.

Further, the pressure in the reaction vessel was lowered to 8.3 kPa, maintained for 1 hour, cooled to 160° C., and returned to atmospheric pressure (first reaction step).

| | |
|---|---|
| Trimellitic acid | 6.3 parts |

(0.03 mol; 18.0 mol % with respect to the total number of moles of polyvalent carboxylic acid)

| | |
|---|---|
| tert-Butyl catechol (polymerization inhibitor) | 0.1 parts |

Thereafter, the above materials were added, the pressure in the reaction vessel was lowered to 8.3 kPa, the reaction was performed for 15 hours while the temperature was maintained at 160° C. After it was confirmed that the reaction product had a softening point of 140° C. measured according to ASTM D36-86, the temperature was lowered and the reaction was stopped (second reaction step) to obtain amorphous polyester (H). The obtained amorphous polyester (H) had a peak molecular weight (Mp) of 8,700, a softening point (Tm) of 142° C., and a glass transition temperature (Tg) of 57° C.

<Preparation Example of Colorant Master Batch 1>

| | |
|---|---|
| Binder resin: Low molecular weight amorphous polyester (L) | 100.00 parts |

-continued

| | |
|---|---|
| Colorant 5 | 30.00 parts |
| Colorant 6 | 70.00 parts |
| Distilled water | 100.00 parts |

The raw materials were first put into a kneader type mixer, and heated under non-pressure while being mixed. After confirming that the raw materials in the aqueous phase are transferred to a molten resin at the highest temperature (which is inevitably determined by the boiling point of the solvent in the paste, corresponding to about 90 to 100° C. in this case), the resultant mixture was heat-melted and kneaded again for 30 minutes, thereby sufficiently transferring the pigment in the paste. Thereafter, the mixer was stopped once, the hot water was discharged, and then the temperature was raised to 110° C. again. A hot melt-kneading was performed for about 30 minutes to disperse the pigment and to distill the water off, and the above-described process was completed. Thereafter, the mixture was cooled, and the kneaded product was taken out and cooled. Then, the product was pulverized to a particle size of about 1 to 2 mm using a hammer mill to obtain Colorant master batch 1.

<Preparation Example of Colorant Master Batches 2 to 4>

Colorant master batches 2 to 4 were obtained by changing the formulation as shown in Table 2 in Preparation Example of Colorant master batch 1.

TABLE 2

| Colorant Master batch | Colorant type | Added amount (Part by mass) | Colorant type | Added amount (Part by mass) | Binder resin | Added amount (Part by mass) |
|---|---|---|---|---|---|---|
| 1 | Colorant 5 | 30 | Colorant 6 | 70 | Amorphous polyester (L) | 100 |
| 2 | Colorant 1 | 85 | Colorant 6 | 15 | Amorphous polyester (L) | 100 |
| 3 | Colorant 1 | 100 | — | — | Amorphous polyester (L) | 100 |
| 4 | Colorant 2 | 100 | — | — | Amorphous polyester (L) | 100 |

<Preparation Example of Crystalline Polyester C1>

| | |
|---|---|
| 1,6-hexanediol: (0.29 mol; 100.0 mol % with respect to the total number of moles of polyvalent alcohol) | 34.5 parts |
| Dodecanedioic acid: (0.28 mol; 100.0 mol % with respect to the total number of moles of polyvalent carboxylic acid) | 65.5 parts |
| Tin 2-ethylhexanoic acid: | 0.5 parts |

The above materials were added to a reaction vessel equipped with a cooling tube, a stirrer, a nitrogen inlet tube, and a thermocouple. The inside of the flask was replaced with nitrogen gas, the temperature was gradually raised with stirring, and the reaction was performed for 3 hours while stirring at a temperature of 140° C. Then, the pressure in the reaction vessel was lowered to 8.3 kPa, and the reaction was performed for 4 hours while maintaining the temperature at 200° C. Thereafter, the pressure in the reaction vessel was lowered to 5 kPa or less and the reaction was performed for 3 hours at 200° C. to obtain crystalline polyester C1.

<Preparation Example of Crystalline Polyesters C2 and C3>

Crystalline polyesters C2 and C3 were obtained in the same manner as in Preparation Example of Crystalline Polyester C1 except that the diol and dicarboxylic acid were changed as shown in Table 3.

The diol, dicarboxylic acid and SP value of the obtained crystalline polyester are shown in Table 3.

TABLE 3

| Crystalline polyester | Diol | Dicarboxylic acid | SP value (SP1) |
|---|---|---|---|
| C1 | 1,6-Hexanediol (C6) | Dodecanedioic acid (C12) | 11.3 |
| C2 | 1,6-Hexanediol (C6) | Sebacic acid (C10) | 11.5 |
| C3 | 1,6-Hexanediol (C6) | Fumaric acid (C4) | 12.7 |

<Preparation Example of Wax Dispersant A1>

In an autoclave reaction vessel equipped with a thermometer and a stirrer, 300.0 parts of xylene and 10.0 parts of polypropylene (melting point of 90° C.) were added and sufficiently dissolved, and after replacement with nitrogen, a mixed solution of 68.0 parts of styrene, 5.0 parts of methacrylic acid, 5.0 parts of cyclohexyl methacrylic acid, 12.0 parts of butyl acrylate, and 250.0 parts of xylene was added dropwise at 180° C. for 3 hours and polymerized. The mixture was again maintained at this temperature for 30 minutes and the solvent was removed to obtain Wax Dispersant A1. Wax Dispersant A1 had an SP value of 10.0.

<Preparation Examples of Wax Dispersants A2, A3, and A4>

Wax Dispersants A2, A3, and A4 were obtained in the same manner as in Preparation Example of Wax Dispersant A1 except that the conditions of the composition and the number of parts of the styrene-acrylic polymer were appropriately changed as shown in Table 4. The formulation and SP value of the wax dispersant are shown in Table 4.

<Preparation Example of Wax Dispersant A5>

In an autoclave reaction vessel equipped with a thermometer and a stirrer, 600.0 parts of xylene and 120.0 parts of polyethylene (melting point of 128° C.) were added and sufficiently dissolved, and after replacement with nitrogen, a mixed solution of 1,900.0 parts of styrene, 170.0 parts of acrylonitrile, 240.0 parts of monobutyl maleate, 78.0 parts of di-t-butylperoxyhexahydroterephthalate, 24.0 parts of butyl acrylate and 455.0 parts of xylene was added dropwise at 160° C. for 2 hours, followed by polymerization. The mixture was again maintained at this temperature for 30 minutes and the solvent was removed to obtain Wax Dispersant A5. Wax Dispersant A5 had an SP value of 10.4.

TABLE 4

| | | | Composition and part by mass of styrene acrylic polymer | | | | | | | | | | |
|---|---|---|---|---|---|---|---|---|---|---|---|---|---|
| | Polyolefin | | Saturated alicyclic compound | | Part by | | | | | | | Part | SP |
| Wax dispersant | Type | Part by mass | Type | Part by mass | mass of styrene | Other compound 1 | Part by mass | Other compound 2 | Part by mass | Other compound 3 | Part by mass | value (SP2) |
| A1 | Polypropylene | 10 | Cyclohexyl methacrylate | 5 | 68 | Methacrylic acid | 5 | Butyl acrylate | 12 | — | — | 10.0 |
| A2 | Polypropylene | 10 | Cyclohexyl methacrylate | 5 | 33 | Methacrylic acid | 40 | Butyl acrylate | 12 | — | — | 10.0 |
| A3 | Polypropylene | 10 | Cyclohexyl acrylate | 5 | 33 | Methacrylic acid | 40 | Butyl acrylate | 12 | — | — | 10.1 |
| A4 | Polypropylene | 10 | Cylclohexyl methacrylate | 5 | 73 | Butyl acrylate | 12 | — | — | — | — | 9.7 |
| A5 | Polyethylene | 4.9 | None | 0 | 77.4 | Butyl acrylate | 1.0 | Acrylonitrile | 6.9 | Monobutyl maleate | 9.8 | 10.4 |

<Preparation Example of Magenta Toner M1>

| | |
|---|---|
| Low molecular weight amorphous polyester (L) | 65.5 parts |
| High molecular weight amorphous polyester (H) | 27.0 parts |
| Crystalline polyester C1 | 7.5 parts |
| Wax dispersant A1 | 5.0 parts |
| Colorant master batch 1 (total content of colorant: 50% by mass) | 15.0 parts |
| Fischer-Tropsch wax (Hydrocarbon wax, peak temperature of highest endothermic peak 90° C.) | 5.0 parts |
| 3,5-Di-t-butylsalicylic acid aluminum compound | 0.3 parts |

The above materials were mixed at a rotation speed of 20 $s^{-1}$ and for a rotation time of 5 min using a Henschel mixer (FM-75 manufactured by Mitsui Mining Co., Ltd.), and then melted and kneaded in a biaxial kneader (PCM-30 manufactured by Ikegai Ironworks Corp.) set at a temperature of 150° C. The obtained melt-kneaded product was cooled and coarsely pulverized with a hammer mill to 1 mm or less to obtain a crude product. The obtained crude product was finely pulverized with a mechanical pulverizer (T-250 manufactured by Turbo Kogyo Co., Ltd.). The pulverized product was subjected to classification again using Faculty F-300 (manufactured by Hosokawa Micron Corporation) to obtain Resin Particle 1. For the operating conditions of Faculty F-300, the number of revolutions of the classification rotor was set to 130 $s^{-1}$, and the number of revolutions of the dispersion rotor was set to 120 $s^{-1}$.

The obtained Resin Particle 1 was heat treated by the heat treatment apparatus shown in FIG. 1 to obtain Toner Particle 1. For the operation conditions, the feed amount was 5 kg/hr, the hot air temperature was 150° C., the hot air flow rate was 6 $m^3$/min, the cold air temperature was −5° C., the cold air flow rate was 4 $m^3$/min, the blower air volume was 20 $m^3$/min, and the injection air flow rate was 1 $m^3$/min.

In 100 parts of Toner Particle 1, 1.0 part of hydrophobic silica (BET specific surface area: 200 $m^2$/g) and 1.0 part of titanium oxide fine particles (BET specific surface area: 80 $m^2$/g) surface-treated with isobutyltrimethoxysilane were mixed at a rotation speed of 30 $s^{-1}$ and for a rotation time of 10 min using a Henschel mixer (FM-75 manufactured by Mitsui Mining Co., Ltd.), thereby obtaining Magenta Toner M1.

In the DSC measurement of the obtained Magenta Toner M1, an endothermic peak derived from the crystalline polyester resin was observed.

<Preparation Examples of Magenta Toners M2 to M15>

Magenta Toners M2 to M15 were obtained in the same manner as in Preparation Example of Magenta Toner M1 except that the kind and the number of parts of the colorant master batch, the content of the colorant, the content of Compound (1), and the types of the crystalline polyester and the wax dispersant were changed as shown in Table 5. Further, the amount of the amorphous polyester (L) to be mixed at the time of kneading was adjusted so that the total amount of amorphous polyester (L) mixed with the amount of amorphous polyester (L) contained in the colorant master batch to be used was 73.0 parts by mass in total.

In the DSC measurement of the obtained Magenta Toners M2 to M15, an endothermic peak derived from the crystalline polyester resin was observed.

In addition, the number average diameter (nm) of the maximum lengths of crystalline polyester crystals and SP2−SP1 values are shown in Table 5.

TABLE 5

| | Colorant master batch | | Colorant content | Content of | | | Number average value of maximum lengths of | |
|---|---|---|---|---|---|---|---|---|
| Toner | Type | (Part by mass) | (Part by mass) | Compound (1) (Part by mass) | Crystalline polyester | Wax dispersant | crystalline polyester crystals (nm) | SP2-SP1 |
| Magenta toner M1 | 1 | 15.0 | 7.5 | 1.6 | C1 | A1 | 22 | 1.3 |
| Magenta toner M2 | 1 | 15.0 | 7.5 | 1.6 | C1 | A2 | 31 | 1.3 |
| Magenta toner M3 | 1 | 15.0 | 7.5 | 1.6 | C1 | A3 | 32 | 1.2 |
| Magenta toner M4 | 1 | 15.0 | 7.5 | 1.6 | C1 | A4 | 35 | 1.6 |
| Magenta toner M5 | 1 | 40.0 | 20.0 | 4.2 | C1 | A4 | 38 | 1.6 |
| Magenta toner M6 | 1 | 10.4 | 5.2 | 1.1 | C1 | A4 | 33 | 1.6 |
| Magenta toner M7 | 1 | 46.2 | 23.1 | 4.8 | C1 | A4 | 40 | 1.6 |
| Magenta toner M8 | 1 | 7.6 | 3.8 | 0.8 | C1 | A4 | 27 | 1.6 |

TABLE 5-continued

| Toner | Colorant master batch Type | Colorant master batch (Part by mass) | Colorant content (Part by mass) | Content of Compound (1) (Part by mass) | Crystalline polyester | Wax dispersant | Number average value of maximum lengths of crystalline polyester crystals (nm) | SP2-SP1 |
|---|---|---|---|---|---|---|---|---|
| Magenta toner M9 | 1 | 7.6 | 3.8 | 0.8 | C2 | A4 | 43 | 1.8 |
| Magenta toner M10 | 1 | 7.6 | 3.8 | 0.8 | C3 | A4 | 45 | 3.0 |
| Magenta toner M11 | 1 | 5.8 | 2.9 | 0.6 | C3 | A4 | 48 | 3.0 |
| Magenta toner M12 | 2 | 46.2 | 23.1 | 19.6 | C3 | A4 | 50 | 3.0 |
| Magenta toner M13 | 3 | 46.2 | 23.1 | 23.1 | C3 | A4 | 72 | 3.0 |
| Magenta toner M14 | 4 | 7.6 | 3.8 | 0.0 | C3 | A4 | 102 | 3.0 |
| Magenta toner M15 | 4 | 7.6 | 3.8 | 0.0 | C3 | A5 | 180 | 2.3 |

<Preparation Example of Cyan Toner C1>

| | |
|---|---|
| Low molecular weight amorphous polyester (L) | 70.0 parts |
| High molecular weight amorphous polyester (H) | 30.0 parts |
| Crystalline polyester C1 | 7.5 parts |
| Wax dispersant A1 | 5.0 parts |
| Fischer-Tropsch wax (Hydrocarbon wax, peak temperature of highest endothermic peak 90° C.) | 5.0 parts |
| C.I. Pigment Blue 15:3 | 7.0 parts |
| 3,5-Di-t-butylsalicylic acid aluminum compound | 0.3 parts |

Cyan Toner C1 was obtained from the above materials by the same preparation method as in Preparation Example of Magenta Toner M1.

<Preparation Examples of Cyan Toners C2 to C7>

Cyan Toners C2 to C7 were obtained by performing the same operations as in Preparation Example of Cyan Toner C1 except that the types of the crystalline polyester and the wax dispersant were changed as shown in Table 6.

In the DSC measurement of the obtained Cyan Toners C2 to C7, an endothermic peak derived from the crystalline polyester resin was observed. In addition, the number average diameter (nm) of the long axis lengths of crystalline polyester crystals and SP2-SP1 values are shown in Table 6.

<Preparation Example of Yellow Toner Y1>

| | |
|---|---|
| Low molecular weight amorphous polyester (L) | 70.0 parts |
| High molecular weight amorphous polyester (H) | 30.0 parts |
| Crystalline polyester C1 | 7.5 parts |
| Wax dispersant A1 | 5.0 parts |
| Fischer-Tropsch wax (Hydrocarbon wax, peak temperature of highest endothermic peak 90° C.) | 5.0 parts |
| C.I. Pigment Yellow 180 | 10.0 parts |
| 3,5-Di-t-butylsalicylic acid aluminum compound | 0.3 parts |

Yellow Toner Y1 was obtained from the above materials by the same preparation method as in Preparation Example of Magenta Toner M1.

<Preparation Examples of Yellow Toners Y2 to Y7>

Yellow Toners Y2 to Y7 were obtained by performing the same operations as in Preparation Example of Yellow Toner Y1 except that the types of the crystalline polyester and the wax dispersant were changed as shown in Table 6.

In the DSC measurement of the obtained Yellow Toners Y2 to Y7, an endothermic peak derived from the crystalline polyester resin was observed. In addition, the number average diameter (nm) of the long axis lengths of crystalline polyester crystals and SP2-SP1 values are shown in Table 6.

<Preparation Example of Black Toner K1>

| | |
|---|---|
| Low molecular weight amorphous polyester (L) | 70.0 parts |
| High molecular weight amorphous polyester (H) | 30.0 parts |
| Crystalline polyester C1 | 7.5 parts |
| Wax dispersant A1 | 5.0 parts |
| Fischer-Tropsch wax (Hydrocarbon wax, peak temperature of highest endothermic peak 90° C.) | 5.0 parts |
| Carbon black Nipex60 (Product manufactured by Evonik Japan: average primary particle diameter of 21 nm, and DBP oil absorption amount of 114 ml/100 g) | 10.0 parts |
| 3,5-Di-t-butylsalicylic acid aluminum compound | 0.3 parts |

Black Toner K1 was obtained from the above materials by the same preparation method as in Preparation Example of Magenta Toner M1.

<Preparation Examples of Black Toners K2 to K7>

Black Toners K2 to K7 were obtained by performing the same operations as in Preparation Example of Black Toner K1 except that the types of the crystalline polyester and the wax dispersant were changed as shown in Table 6.

In the DSC measurement of the obtained Black Toners K2 to K7, an endothermic peak derived from the crystalline polyester resin was observed. In addition, the number average diameter (nm) of the long axis lengths of crystalline polyester crystals and SP2-SP1 values are shown in Table 6.

TABLE 6

| Toner | Crystalline polyester | Wax dispersant | Number average value of long axis lengths of crystalline polyester crystals (nm) | SP2-SP1 |
|---|---|---|---|---|
| Cyan toner C1 | C1 | A1 | 81 | 1.3 |
| Cyan toner C2 | C1 | A2 | 103 | 1.0 |
| Cyan toner C3 | C1 | A3 | 105 | 1.2 |
| Cyan toner C4 | C1 | A4 | 122 | 1.6 |
| Cyan toner C5 | C2 | A4 | 248 | 1.8 |
| Cyan toner C6 | C3 | A4 | 278 | 3.0 |
| Cyan toner C7 | C3 | A5 | 350 | 2.3 |
| Yellow toner Y1 | C1 | A1 | 84 | 1.3 |
| Yellow toner Y2 | C1 | A2 | 106 | 1.0 |
| Yellow toner Y3 | C1 | A3 | 107 | 1.2 |
| Yellow toner Y4 | C1 | A4 | 120 | 1.6 |
| Yellow toner Y5 | C2 | A4 | 251 | 1.8 |
| Yellow toner Y6 | C3 | A4 | 290 | 3.0 |
| Yellow toner Y7 | C3 | A5 | 344 | 2.3 |
| Black toner K1 | C1 | A1 | 87 | 1.3 |
| Black toner K2 | C1 | A2 | 105 | 1.0 |
| Black toner K3 | C1 | A3 | 106 | 1.2 |
| Black toner K4 | C1 | A4 | 118 | 1.6 |
| Black toner K5 | C2 | A4 | 256 | 1.8 |
| Black toner K6 | C3 | A4 | 288 | 3.0 |
| Black toner K7 | C3 | A5 | 349 | 2.3 |

<Preparation Example of Magnetic Core Particle 1>

| Process 1 (weighing and mixing process): | |
|---|---|
| $Fe_2O_3$ | 62.7 Parts |
| $MnCO_3$ | 29.5 Parts |
| $Mg(OH)_2$ | 6.8 Parts |
| $SrCO_3$ | 1.0 Part |

Ferrite raw material was weighed so that the above-described materials had the above-described composition ratio. Thereafter, the mixture was pulverized and mixed for 5 hours with a dry vibration mill using stainless steel beads having a diameter of ⅛ inch.

Process 2 (Prefiring Process):

The obtained pulverized product was prepared as a pellet having a size of about 1 mm by 1 mm using a roller compactor. The coarse powder was removed from the pellet with a vibration sieve having an opening of 3 mm, and subsequently, the fine powder was removed with a vibration sieve having an opening of 0.5 mm. The product was fired under a nitrogen atmosphere (oxygen concentration: 0.01% by volume) using a burner type firing furnace at a temperature of 1,000° C. for 4 hours to produce a calcined ferrite. The composition of the obtained calcined ferrite is as follows.

$$(MnO)_a(MgO)_b(SrO)_c(Fe_2O_3)_d$$

In Formula above, a=0.257, b=0.117, c=0.007, d=0.393

Process 3 (Pulverizing Process):

After pulverizing the obtained calcined ferrite to about 0.3 mm with a crusher, 30 parts of water was added to 100 parts of the calcined ferrite using ⅛-inch diameter zirconia beads and pulverized with a wet ball mill for 1 hour. The slurry was pulverized with a wet ball mill using alumina beads having a diameter of 1/16 inch for 4 hours to obtain ferrite slurry (finely pulverized product of calcined ferrite).

Process 4 (Granulation Process):

To the ferrite slurry, 1.0 part of ammonium polycarboxylate as a dispersant and 2.0 parts of polyvinyl alcohol as a binder were added based on 100 parts of the calcined ferrite, and granulated into a spherical particle with a spray drier (manufactured by Ohkawara Kakohki Co., Ltd.). The obtained particles were adjusted in view of a particle size and then heated at 650° C. for 2 hours using a rotary kiln to remove organic components of the dispersant and the binder.

Process 5 (Firing Process):

In order to control the firing atmosphere, the temperature was raised from room temperature to a temperature of 1,300° C. under a nitrogen atmosphere (oxygen concentration 1.00% by volume) for 2 hours with an electric furnace and then the particles were fired at a temperature of 1,150° C. for 4 hours. Thereafter, the temperature was lowered to 60° C. over 4 hours, the atmosphere was returned to the atmosphere from the nitrogen atmosphere, and the particles were taken out at a temperature of 40° C. or less.

Process 6 (Sorting Process):

After crushing the aggregated particles, the low magnetic force product was cut by magnetic separation, and coarse particles were removed by sieving with a sieve having an opening of 250 μm to obtain Magnetic Core Particle 1 having a 50% particle diameter (D50) of 37.0 μm based on volume distribution.

<Preparation of Coating Resin 1>

| | |
|---|---|
| Cyclohexylmethacrylate monomer | 26.8% by mass |
| Methyl methacrylate monomer | 0.2% by mass |
| Methyl methacrylate macromonomer | 8.4% by mass |

(Macromonomer having a methacryloyl group at one end and a weight average molecular weight of 5,000)

| | |
|---|---|
| Toluene | 31.3% by mass |
| Methyl ethyl ketone | 31.3% by mass |
| Azobisisobutyronitrile | 2.0% by mass |

Among the above materials, the cyclohexyl methacrylate monomer, the methyl methacrylate monomer, the methyl methacrylate macromonomer, the toluene, and the methyl ethyl ketone were charged into a four-necked separable flask equipped with a reflux condenser, a thermometer, a nitrogen inlet tube, and a stirrer, and nitrogen gas was introduced to make a sufficient nitrogen atmosphere, and then the temperature was raised to 80° C. Thereafter, azobisisobutyronitrile was added, and the mixture was refluxed for 5 hours to polymerize. Hexane was injected into the obtained reaction product, and the copolymer was precipitated and extracted. The precipitate was separated by filtration and vacuum dried to obtain Coating Resin 1.

In 40 parts of toluene and 30 parts of methyl ethyl ketone, 30 parts of the obtained Coating Resin 1 was dissolved to obtain Polymer Solution 1 (solid content 30% by mass).

<Preparation of Coating Resin Solution 1>

| | |
|---|---|
| Polymer solution 1 (resin solid concentration 30%) | 33.3% by mass |
| Toluene | 66.4% by mass |
| Carbon black (Regal 330 manufactured by Cabot Corporation) | 0.3% by mass |

(Primary particle size of 25 nm, nitrogen adsorption specific surface area of 94 $m^2/g$, DBP oil absorption amount of 75 ml/100 g)

These materials were dispersed for 1 hour with a paint shaker using zirconia beads having a diameter of 0.5 mm. The obtained dispersion was filtered through a 5.0 μm membrane filter to obtain Coating Resin Solution 1.

<Preparation Example of Magnetic Carrier 1>

(Resin Coating Step):

To a vacuum degassed kneader kept at room temperature, Coating Resin Solution 1 as a resin component was added in an amount of 2.5 parts with respect to 100 parts of Magnetic Core Particle 1. After the addition, the mixture was stirred at a rotational speed of 30 rpm for 15 minutes. After the solvent was volatilized to a predetermined level (80% by mass), the product was mixed under reduced pressure while raising the temperature to 80° C., then toluene was distilled over 2 hours, and the mixture was cooled.

From the obtained magnetic carrier, the low magnetic force product was separated by magnetic separation, and passed through a sieve having an opening of 70 μm, and classified with a wind power classifier to obtain Magnetic Carrier 1 having a 50% particle size (D50) of 38.2 μm based on volume distribution.

To Magnetic Carrier 1, each toner was added so that the toner concentration was 8.0% by mass, and mixed using a V type mixer (V-10 type manufactured by Tokuju Corporation) at 0.5 $s^{-1}$ for a rotation time of 5 min to obtain a two-component type developer.

Examples 1 to 12 and Comparative Examples 1 to 3

Evaluation was conducted with the toner kits in the combination shown in Table 7.

TABLE 7

| Example | Magenta | Cyan | Black | Yellow |
|---|---|---|---|---|
| Example 1 | M1 | C1 | K1 | Y1 |
| Example 2 | M2 | C2 | K2 | Y2 |
| Example 3 | M3 | C3 | K3 | Y3 |
| Example 4 | M4 | C4 | K4 | Y4 |
| Example 5 | M5 | C4 | K4 | Y4 |
| Example 6 | M6 | C4 | K4 | Y4 |
| Example 7 | M7 | C4 | K4 | Y4 |
| Example 8 | M8 | C4 | K4 | Y4 |
| Example 9 | M9 | C5 | K5 | Y5 |
| Example 10 | M10 | C6 | K6 | Y6 |
| Example 11 | M11 | C6 | K6 | Y6 |
| Example 12 | M12 | C6 | K6 | Y6 |
| Comparative Example 1 | M13 | C6 | K6 | Y6 |
| Comparative Example 2 | M14 | C6 | K6 | Y6 |
| Comparative Example 3 | M15 | C7 | K7 | Y7 |

As an image forming apparatus, a printer for digital commercial printing manufactured by Canon, imageRUNNER ADVANCE C9075 PRO modified machine was used. Each two-component-based developer was put into each developing machine, and the direct current voltage $V_{DC}$ of the developer support, the charging voltage $V_D$ of the electrostatic latent support, and the laser power were adjusted so that an applied toner amount on the paper or on the electrostatic latent support was desired. Then, evaluation to be described below was performed. Modifications were made so as to freely set the fixation temperature and the process speed.

Evaluation was performed by the following evaluation method, and the results are shown in Table 8.

<Evaluation 1: Low-Temperature Fixability>

Paper: CS-680 (68.0 g/m$^2$)

(Sold by Canon Marketing Japan Incorporated)

Applied toner amount: 1.20 mg/cm$^2$

Evaluation image: YMCK monochrome FFh image (2 cm×2 cm) is arranged at the center of the A4 paper Fixation test environment: Low temperature and low humidity environment, 15° C./10% RH (hereinafter, referred to as "L/L")

Process speed: 450 mm/sec

Fixation temperature: 130° C.

The low-temperature fixability of the fixed image output under the above conditions was evaluated using the image forming apparatus.

The evaluation of low-temperature fixability was performed by using the following image concentration reduction rate value as an index.

For the image concentration reduction rate, the concentration of the fixation image at the center is first measured using an X-Rite color reflection densitometer (500 series: manufactured by X-Rite Co.). Next, a load of 4.9 kPa (50 g/cm$^2$) was applied to the portion where the concentration of the fixation image was measured, the fixation image was rubbed (repeated 5 times) with a cleaning paper was measured, and the concentration of the fixation image was measured again. Then, the reduction rate (%) of the concentration of the fixation image before and after rubbing was measured by Equation below.

Reduction rate of each image concentration=(image concentration of each color after friction−image concentration of each color before friction)/image concentration of each color before friction (Evaluation Criteria)

A: Concentration reduction rate is less than 1.0%

B: Concentration reduction rate is 1.0% or more and less than 5.0%

C: Concentration reduction rate is 5.0% or more and less than 10.0%

D: Concentration reduction rate is 10.0% or more

<Evaluation 2: Hot Offset Resistance>

Paper: CS-680 (68.0 g/m$^2$)

(Sold by Canon Marketing Japan Incorporated)

Applied toner amount: 0.08 mg/cm$^2$

Evaluation image: YMCK monochrome halftone image (2 cm×2 cm) is arranged at the center of the A4 paper Fixation test environment: Room temperature and low humidity environment: Temperature 23° C./Humidity 5% RH (hereinafter, referred to as "N/L")

Process speed: 321 mm/sec

Fixation temperature: 200° C.

After preparing the unfixed image, hot offset resistance was evaluated. As a procedure, ten sheets of plain postcards were first fed through the center position of the fixation belt, and then the unfixed image was fed through. The fog value was used as an evaluation index of hot offset. The fog was determined by measuring an average reflectance Dr (%) of the evaluation paper before image output and a reflectance Ds (%) of the white background portion after the fixation test using a reflectometer ("REFLECTOMETER MODEL TC-6DS" manufactured by TokyoDenshoku co., Ltd.) and performing calculation using Formula below. The obtained fog was evaluated according to the following Evaluation Criteria.

$$\text{Fog}\ (\%)=Dr(\%)-Ds(\%)$$

(Evaluation Criteria)

A: Less than 0.2%

B: 0.2% or more and less than 0.5%

C: 0.5% or more and less than 1.0%

D: 1.0% or more

<Evaluation 3: Evaluation of Coloring Power>

Paper: CS-680 (68.0 g/m$^2$)

(Sold by Canon Marketing Japan Incorporated)

Applied toner amount: 0.35 mg/cm$^2$

Evaluation image: YMCK monochrome FFh image (2 cm×2 cm) is arranged at the center of the A4 paper Fixation test environment: Room temperature and low humidity environment: Temperature 23° C./Humidity 50% RH (hereinafter, referred to as "N/N")

Process speed: 321 mm/sec

Fixation temperature: 170° C.

After the image was prepared, an image was output in a state in which the developing bias was constant, and the image concentration of the output image was examined. The image concentration was measured using an X-Rite color reflection densitometer (500 series: manufactured by X-Rite Inc.).

From the results of the X-Rite color reflection densitometer, the coloring power of the toner was evaluated according to the following criteria.

(Evaluation Criteria)

A: 1.30 or more

B: 1.25 or more and less than 1.30

C: 1.20 or more and less than 1.25

D: Less than 1.20

The above evaluation results are shown in Table 8 below.

TABLE 8

| | Low-temperature fixability | | | | Eval- | Hot offset resistance | | | | Eval- | Coloring power | | | | Eval- |
|---|---|---|---|---|---|---|---|---|---|---|---|---|---|---|---|
| Example | Magenta | Cyan | Black | Yellow | uation | Magenta | Cyan | Black | Yellow | uation | Magenta | Cyan | Black | Yellow | uation |
| Example 1 | 0.7 | 0.7 | 0.7 | 0.7 | A | 0.1 | 0.1 | 0.1 | 0.1 | A | 1.34 | 1.34 | 1.33 | 1.35 | A |
| Example 2 | 0.8 | 0.8 | 0.8 | 0.8 | A | 0.1 | 0.1 | 0.1 | 0.1 | A | 1.34 | 1.34 | 1.33 | 1.35 | A |
| Example 3 | 0.8 | 0.8 | 0.8 | 0.8 | A | 0.1 | 0.1 | 0.1 | 0.1 | A | 1.34 | 1.34 | 1.33 | 1.35 | A |
| Example 4 | 0.9 | 0.9 | 0.9 | 0.9 | A | 0.1 | 0.1 | 0.1 | 0.1 | A | 1.34 | 1.34 | 1.33 | 1.35 | A |
| Example 5 | 1.5 | 0.9 | 0.9 | 0.9 | B | 0.1 | 0.1 | 0.1 | 0.1 | A | 1.35 | 1.34 | 1.33 | 1.35 | A |
| Example 6 | 0.9 | 0.9 | 0.9 | 0.9 | A | 0.1 | 0.1 | 0.1 | 0.1 | A | 1.32 | 1.34 | 1.33 | 1.35 | A |
| Example 7 | 2.8 | 0.9 | 0.9 | 0.9 | B | 0.1 | 0.1 | 0.1 | 0.1 | A | 1.35 | 1.34 | 1.33 | 1.35 | A |
| Example 8 | 0.9 | 0.9 | 0.9 | 0.9 | A | 0.1 | 0.1 | 0.1 | 0.1 | A | 1.27 | 1.34 | 1.33 | 1.35 | B |
| Example 9 | 2.1 | 2.5 | 2.4 | 2.4 | B | 0.3 | 0.2 | 0.3 | 0.3 | B | 1.26 | 1.28 | 1.27 | 1.29 | B |
| Example 10 | 5.8 | 4.2 | 4.8 | 4.7 | C | 0.4 | 0.4 | 0.4 | 0.4 | B | 1.25 | 1.27 | 1.26 | 1.27 | B |
| Example 11 | 5.5 | 4.2 | 4.8 | 4.7 | C | 0.6 | 0.4 | 0.4 | 0.4 | C | 1.23 | 1.27 | 1.26 | 1.27 | C |
| Example 12 | 7.8 | 4.2 | 4.8 | 4.7 | C | 0.7 | 0.4 | 0.4 | 0.4 | C | 1.24 | 1.27 | 1.26 | 1.27 | C |
| Comparative Example 1 | 10.8 | 4.2 | 4.8 | 4.7 | D | 1.0 | 0.4 | 0.4 | 0.4 | D | 1.19 | 1.27 | 1.26 | 1.27 | D |
| Comparative Example 2 | 11.0 | 4.2 | 4.8 | 4.7 | D | 1.2 | 0.4 | 0.4 | 0.4 | D | 1.18 | 1.27 | 1.26 | 1.27 | D |
| Comparative Example 3 | 13.0 | 10.5 | 10.6 | 11.0 | D | 1.3 | 1.0 | 1.1 | 1.2 | D | 1.17 | 1.19 | 1.18 | 1.19 | D |

As shown from the above-described results, in the magenta toner containing the crystalline polyester, the wax dispersant has a structural moiety derived from cyclohexyl (meth)acrylate, and the colorant contains Compound (1) in an amount of 0.5 parts by mass or more and 20.0 parts by mass or less and contains one or more compounds selected from the group consisting of naphthol-based compounds, quinacridone-based compounds and lake compounds thereof, thereby obtaining a toner in which the crystals of the crystalline polyester are dispersed to 50 nm or less, and fixability, hot offset resistance, and coloring power are excellent.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-233024, filed Dec. 5, 2017, which is hereby incorporated by reference herein in its entirety.

What is claimed is:

1. A magenta toner comprising a magenta toner particle containing a binder resin, a colorant, a wax, a wax dispersant, and a crystalline polyester, wherein the wax dispersant is a graft polymer in which a styrene acrylic resin is grafted to a hydrocarbon compound, and the styrene acrylic resin has a monomer unit having a saturated alicyclic group, the colorant contains Compound (1) represented by Formula below, (1)

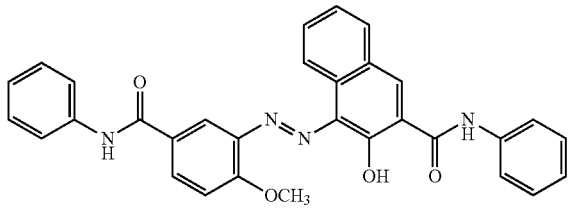

a content of the compound (1) in the magenta toner particles is 0.5 parts by mass or more and 20.0 parts by mass or less with respect to 100 parts by mass of the binder resin, the colorant further contains, in addition to the compound (1), at least one compound selected from the group consisting of a naphthol-based compound, a quinacridone-based compound, and a lake compound thereof, when observing a cross-section of the magenta toner particle using a transmission electron microscope (TEM), crystals of the crystalline polyester are dispersed in the cross-section, and the number average value of maximum lengths of the crystals is 50 nm or less.

2. The magenta toner according to claim 1, wherein the binder resin contains an amorphous polyester resin.

3. The magenta toner according to claim 1, wherein a content of the crystalline polyester in the magenta toner particle is 1.0 part by mass or more and 15.0 parts by mass or less with respect to 100 parts by mass of the binder resin.

4. The magenta toner according to claim 1, wherein the monomer unit having a saturated alicyclic group has the following structure:

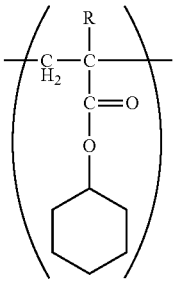

(in Formula, R represents a hydrogen atom or a methyl group).

5. The magenta toner according to claim 1, wherein a content of the colorant in the magenta toner particle is 5.0 parts by mass or more and 25.0 parts by mass or less with respect to 100 parts by mass of the binder resin.

6. A toner kit comprising:

a cyan toner, a black toner, a yellow toner, and a magenta toner, wherein the magenta toner has a magenta toner particle containing a binder resin, a colorant, a wax, a wax dispersant, and a crystalline polyester, the wax dispersant is a graft polymer in which a styrene acrylic resin is grafted to a hydrocarbon compound, and the styrene acrylic resin has a monomer unit having a saturated alicyclic group, the colorant contains Compound (1) represented by Formula below, (1)

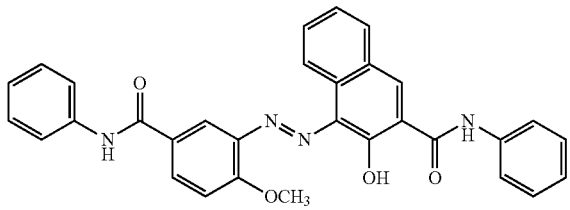

a content of the compound (1) in the magenta toner particle is 0.5 parts by mass or more and 20.0 parts by mass or less with respect to 100 parts by mass of the binder resin, the colorant further contains, in addition to the compound (1), at least one compound selected from the group consisting of a naphthol-based compound, a quinacridone-based compound, and a lake compound thereof, when observing a cross-section of the magenta toner particle using a transmission electron microscope (TEM), crystals of the crystalline polyester are dispersed in the cross-section, the number average value of maximum lengths of the crystals is 50 nm or less, the black toner is a black toner having a black toner particle containing a binder resin, a colorant, a wax, a wax dispersant, and a crystalline polyester, the yellow toner is a yellow toner having an yellow toner particle containing a binder resin, a colorant, a wax, a wax dispersant, and a crystalline polyester, the cyan toner is a cyan toner having a cyan toner particle containing a binder resin, a colorant, a wax, a wax dispersant, and a crystalline polyester, each of the wax dispersants in the black toner particle, the yellow toner particle, and the cyan toner particle is a graft polymer in which a styrene acrylic resin is grafted to a hydrocarbon compound, and the styrene acrylic resin has a monomer unit having a saturated alicyclic group, and when observing a cross-section of each of the black toner particle, the yellow toner particle, and the cyan toner particle using a transmission electron microscope (TEM), crystals of the crystalline polyester observed in a needle shape are dispersed in each cross-section, and the number average value of long axis lengths of the crystals to be observed is 60 nm or more and 250 nm or less, respectively.

7. The toner kit according to claim 6, wherein the binder resin in the black toner particle, the yellow toner particle, and the cyan toner particle contains an amorphous polyester resin, respectively.

8. The toner kit according to claim 6, wherein each content of the crystalline polyester in the black toner particle, the yellow toner particle, and the cyan toner particle is 1.0 part by mass or more and 15.0 parts by mass or less with respect to 100 parts by mass of the binder resin.

9. The toner kit according to claim 6, wherein the monomer unit having a saturated alicyclic group of the wax dispersant in the black toner particle, the yellow toner particle, and the cyan toner particle has the following structure:

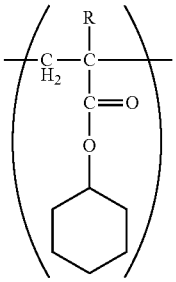

(in Formula, R represents a hydrogen atom or a methyl group).

10. The toner kit according to claim 6, wherein a solubility parameter SP1 of the crystalline polyester and a solubility parameter SP2 of the wax dispersant in the magenta toner particle, the black toner particle, the yellow toner particle, and the cyan toner particle satisfy the relationship of Formula below, respectively:

$$0 \leq SP1 - SP2 \leq 1.3.$$

* * * * *